US009323186B2

(12) United States Patent
Kita et al.

(10) Patent No.: US 9,323,186 B2
(45) Date of Patent: Apr. 26, 2016

(54) IMAGE FORMING APPARATUS

(71) Applicant: CANON KABUSHIKI KAISHA, Tokyo (JP)

(72) Inventors: Hiroshi Kita, Mishima (JP); Minoru Hayasaki, Mishima (JP); Kimitaka Ichinose, Mishima (JP); Michio Uchida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/571,662

(22) Filed: Dec. 16, 2014

(65) Prior Publication Data

US 2015/0168889 A1 Jun. 18, 2015

(30) Foreign Application Priority Data

Dec. 18, 2013 (JP) ..... 2013-261300

(51) Int. Cl.
*G03G 15/20* (2006.01)

(52) U.S. Cl.
CPC .... *G03G 15/2039* (2013.01); *G03G 2215/2035* (2013.01)

(58) Field of Classification Search
CPC ..... G03G 15/2053; G03G 15/2028; G03G 15/2039; G03G 15/2085; G03G 15/205; G03G 15/2064; G03G 15/2017; G03G 15/2025; G03G 15/2032; G03G 15/2057; G03G 15/2078; G03G 2215/2032; G03G 21/1685
See application file for complete search history.

(56) References Cited

U.S. PATENT DOCUMENTS

| | | | | |
|---|---|---|---|---|
| 7,177,579 | B2 | 2/2007 | Uchida et al. | |
| 7,283,780 | B2 | 10/2007 | Uchida et al. | |
| 7,512,370 | B2 | 3/2009 | Shimizu et al. | |
| 7,865,120 | B2 | 1/2011 | Suzuki et al. | |
| 8,811,872 | B2 | 8/2014 | Nakagawa et al. | |
| 8,811,876 | B2 | 8/2014 | Endo et al. | |
| 8,824,904 | B2 | 9/2014 | Sasaki et al. | |
| 2004/0151513 | A1* | 8/2004 | Nomura | 399/8 |
| 2006/0291920 | A1* | 12/2006 | Hong et al. | 399/328 |
| 2011/0052217 | A1* | 3/2011 | Mochizuki | 399/10 |
| 2012/0219308 | A1 | 8/2012 | Fukaya | |
| 2012/0301162 | A1 | 11/2012 | Sasaki et al. | |
| 2013/0108287 | A1 | 5/2013 | Hayase et al. | |

FOREIGN PATENT DOCUMENTS

| | | | |
|---|---|---|---|
| JP | 2010-134035 | A | 6/2010 |
| JP | 2011-248098 | A | 12/2011 |
| JP | 2012-177790 | A | 9/2012 |
| JP | 2012-247552 | A | 12/2012 |
| JP | 2013-92726 | A | 5/2013 |

* cited by examiner

*Primary Examiner* — Roy Y Yi
(74) *Attorney, Agent, or Firm* — Fitzpatrick, Cella, Harper & Scinto

(57) ABSTRACT

An image forming apparatus for forming an image on a recording material includes: an image forming portion for forming the image on the recording material; a fixing portion, including a cylindrical rotatable member having a heat generating layer, for fixing the image on the recording material by heat of the rotatable member; and a temperature detecting portion for detecting a temperature of the rotatable member. The temperature detecting portion monitors a temperature change amount during one rotation of the rotatable member. The rotatable member is heated by the heat generating layer generating heat by a flow of a current in a circumferential direction of the rotatable member. Depending on the temperature change amount, a notification of an abnormality of the image forming apparatus is generated.

13 Claims, 20 Drawing Sheets

(a)

(b)

(a)

(b)

a1 : RADIUS OF CORE
a2 : INNER DIAMETER
a3 : OUTER DIAMETER
μ0 : AIR PERMEABILITY
μ1 : CORE PERMEABILITY
μ2 : LAYER PERMEABILITY (a)

(b)

(a)

(b)

IMAGE FORMING APPARATUS

FIELD OF THE INVENTION AND RELATED ART

The present invention relates to an image forming apparatus, including a fixing device, such as an electrophotographic copying machine or an electrophotographic printer.

In the electrophotographic copying machine or printer, a toner image corresponding to an image data is transferred onto a recording material such as recording paper or an OHP sheet, and thereafter is fixed on the recording material by heating and pressing the toner image, transferred on the recording material, by the fixing device.

As the fixing device, a device (apparatus) having a constitution in which a cylindrical heat generating fixing belt (hereinafter referred to as a cylindrical rotatable member) having a heat generating resistance layer generating heat by a flow of a current has been known.

For example, in Japanese Laid-Open Patent Application (JP-A) 2011-248098, a fixing device in which a nip is formed by bringing a pressing roller into press-contact with a cylindrical rotatable member having a heat generating resistance layer molded by dispersing an electroconductive filler and a high-ion-conductive powder into a heat-resistant resin material such as polyimide is disclosed.

The thermal capacity of the cylindrical rotatable member of this fixing device is small, so that the warming-up time becomes short, and thus the fixing device can be maintained at a predetermined fixing temperature with low electric power. As a result, it becomes possible to heat-fix the toner image on the recording material at a high speed with low electric power.

In the case where a crack is produced so as to block the path of the current passing through the rotatable member, the current concentratedly passes through an end portion of the crack, so that the temperature increases locally in some instances. There is a possibility that the local temperature increase of the rotatable member causes an image defect, such as an image non-uniformity or hot offset. In order to prevent generation of an image defect, it is preferable that the crack of the rotatable member is detected as soon as possible, and then a warning to that effect is provided to a user.

Therefore, in JP A 2010 134035, as a detecting method of the crack generated in the cylindrical rotatable member, a method for detecting an abnormal temperature increase by using a temperature sensing element is disclosed. However, when the rotatable member rotates at a high speed, the response of the temperature sensing element cannot keep up with the rotation, so that an abnormal temperature increase portion cannot be directly detected in some cases.

SUMMARY OF THE INVENTION

According to an aspect of the present invention, there is provided an image forming apparatus for forming an image on a recording material, comprising: an image forming portion for forming the image on the recording material; a fixing portion, including a cylindrical rotatable member having a heat generating layer, for fixing the image on the recording material by heat of the rotatable member; and a temperature detecting portion for detecting a temperature of the rotatable member, wherein the temperature detecting portion monitors a temperature change amount during one rotation of the rotatable member. The rotatable member is heated by the heat generating layer generating heat by the flow of a current in a circumferential direction of the rotatable member. Depending on the temperature change amount, a notification of an abnormality of the image forming apparatus is provided.

According to another aspect of the present invention, there is provided an image forming apparatus for forming an image on a recording material, comprising: an image forming portion for forming the image on the recording material; and a fixing portion for fixing the image on the recording material by heating of the recording material. The fixing portion includes a cylindrical rotatable member having a heat generating layer, a magnetic member inserted into a hollow portion of the rotatable member, and a coil wound helically outside the magnetic member at the hollow portion. The apparatus also comprises a temperature detecting portion for detecting the temperature of the rotatable member. The temperature detecting portion monitors a temperature change amount during one rotation of the rotatable member. The rotatable member is heated by the heat generating layer generating heat through electromagnetic induction heating by an AC magnetic field generated by a flow of a current through the coil. Depending on the temperature change amount, a notification of an abnormality of the image forming apparatus is produced.

These and other objects, features and advantages of the present invention will become more apparent upon a consideration of the following description of the preferred embodiments of the present invention taken in conjunction with the accompanying drawings.

DESCRIPTION OF THE EMBODIMENTS

[Embodiment 1]

Embodiments of the present invention will be described specifically with reference to the drawings. Although the following embodiments are examples of preferred embodiments of the present invention, the present invention is not limited thereto, but constitutions thereof can also be replaced with other known constitutions within the scope of the concept of the present invention.

(1) Image Forming Apparatus 100

Figure 2:
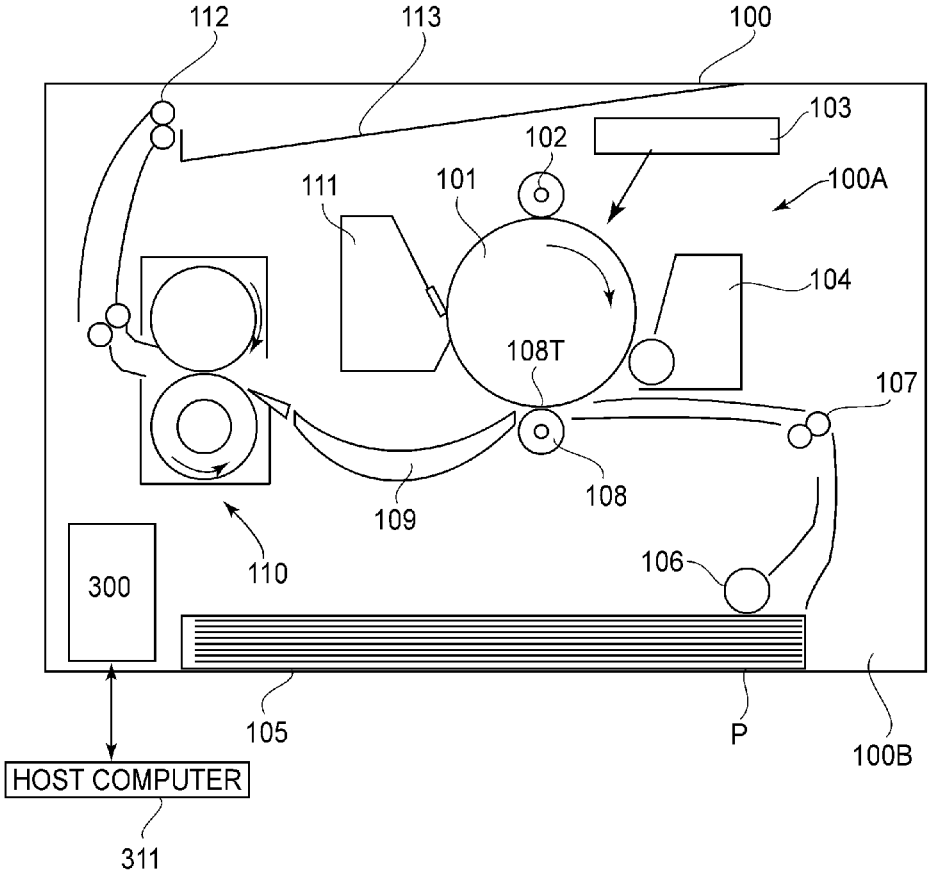
FIG. 2 is a sectional view of the image forming apparatus.

With reference to FIG. 2, an image forming apparatus 100 according to the present invention in which a fixing device 110 is mounted will be described. FIG. 2 is a sectional view showing the general structure of the image forming apparatus 100 (monochromatic printer in this embodiment) using electrophotographic technology.

In the image forming apparatus 100, an image forming portion 100A for forming a toner image on a recording material P includes a photosensitive drum 101 as an image bearing member, a charging member 102, a laser scanner 103 and a developing device 104. The image forming portion 100A further includes a cleaner 111 for cleaning the photosensitive drum 101, and a transfer member 108. The operation of the image forming portion 100A is well known and therefore a detailed description thereof will be omitted.

The recording material P accommodated in a cassette 105 in a main assembly 100B of the image forming apparatus 100 is fed one by one by rotation of a roller 106. The recording material P is fed by rotation of a roller 107 to a transfer nip 108T formed by the photosensitive drum 101 and a transfer member 108. The recording material P on which a toner image is transferred at the transfer nip 108T is sent to the fixing device (fixing portion) 110 via a feeding guide 109, in which the toner image is heat-fixed on the recording material P by the fixing device 110. The recording material P coming out of the fixing device 110 is discharged onto a tray 113 by rotation of a roller 112.

(2) Fixing Device 110

Figure 3:
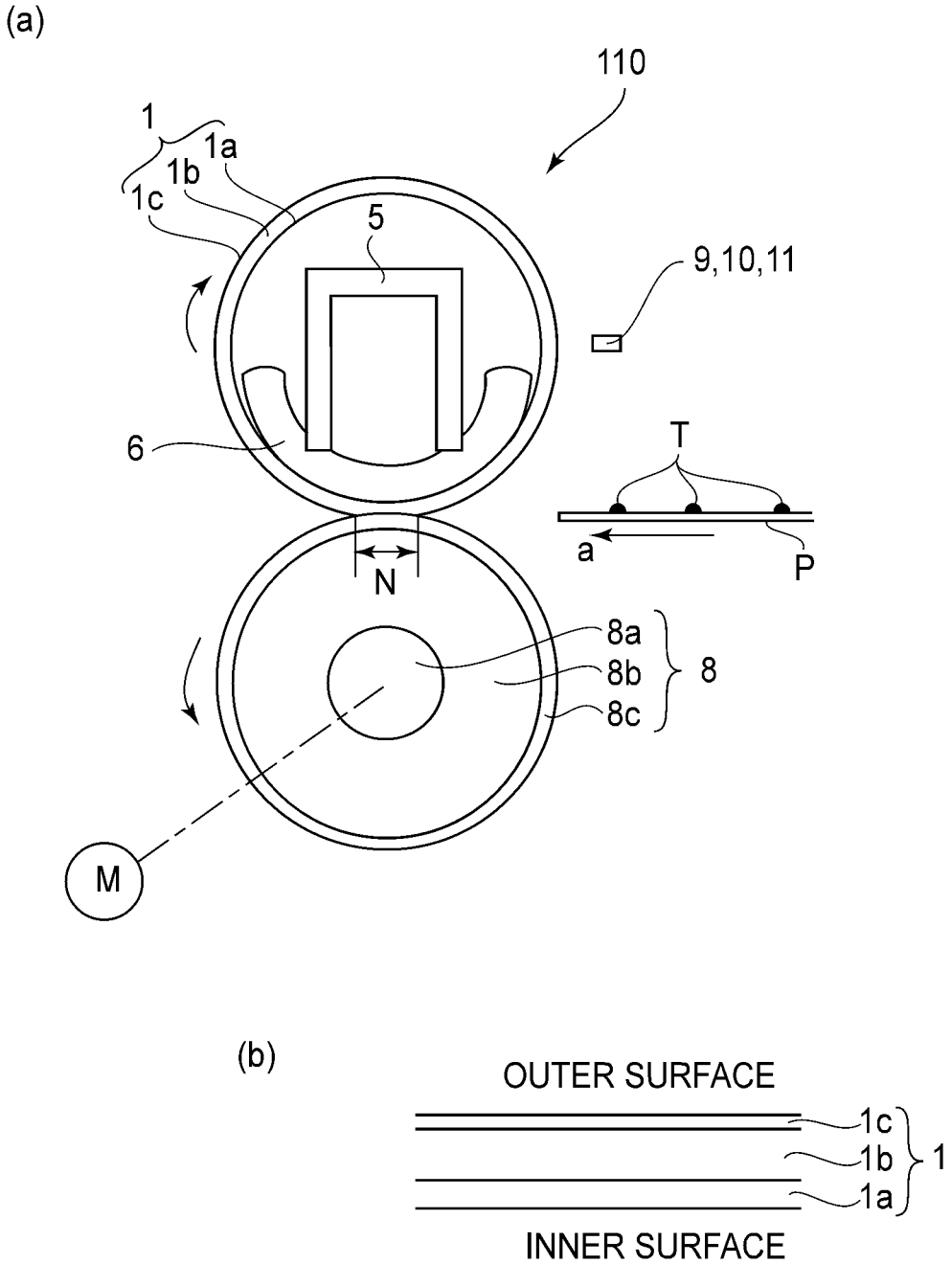
In FIG. 3, (*a*) is a sectional view of the fixing device in Embodiment 1, and (*b*) is a sectional view of a layer structure of a film in Embodiment 1.
Figure 4:
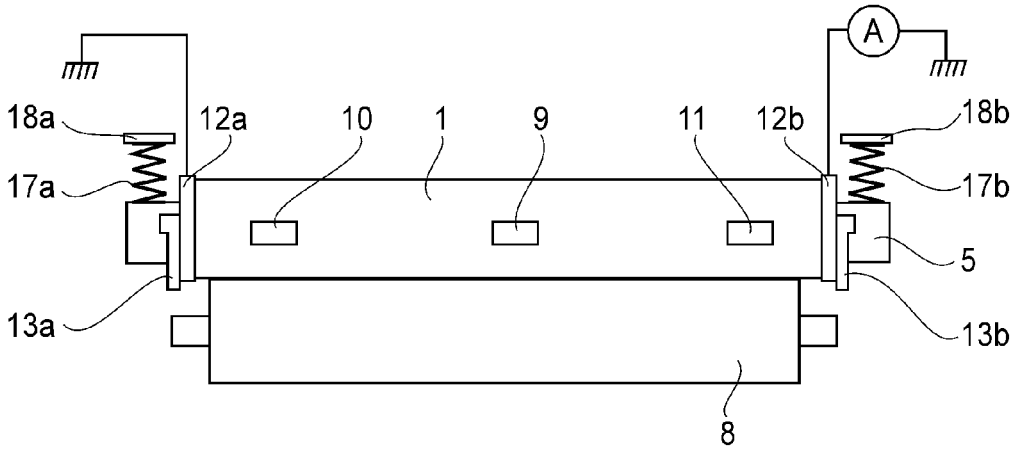
FIG. 4 is a front view of the fixing device in Embodiment 1.

The fixing device 110 in this embodiment will be described with reference to FIGS. 3 and 4. In FIG. 3, (*a*) is a sectional view showing the general structure of an example of the fixing device 110 of an energization heat-generating type in this embodiment, and (*b*) is a sectional view showing a layer structure of a film 1 of the fixing device 110. FIG. 4 is a front view of the fixing device 110 (FIG.3) as seen from a recording-material-feeding side thereof.

A pressing roller 8 as a pressing member includes a metal core 8*a*, a heat-resistant elastic (material) layer 8*b* formed at an outer peripheral surface of the metal core 8*a* between longitudinal shaft end portions of the metal core 8*a*, and a parting layer (surface layer) 8*c* formed at an outer peripheral surface of the elastic layer 8*b*. The longitudinal direction refers to a direction perpendicular to a recording material feeding direction a. As a material for the elastic layer 8*b*, a material having a good heat-resistant property, such as a silicone rubber, a fluorine containing rubber, or a fluorosilicone rubber may preferably be used. Each of the longitudinal shaft end portions of the metal core 8*a* is rotatably supported by an unshown frame via a bearing.

Into the cylindrical film 1 as a cylindrical rotatable member, a nip forming member 6 and a stay 5 as a reinforcing member are inserted. The nip forming member 6 is formed of a heat-resistant resin material, such as PPS, and opposes the pressing roller 8 via the film 1. The stay 5, disposed on the nip forming member 6, is supported by the above-described frame at each of left and right longitudinal end portions of the stay 5. Pressing springs 17*a* and 17*b* are compressedly provided between spring receiving members 18*a* and 18*b* (FIG.4) provided on the frame at the left and right end portions of the stay 5, and the nip forming member 6 is pressed by these pressing springs 17*a* and 17*b* in a direction perpendicular to a generatrix direction of the pressing roller 8. In this embodiment, a pressure (urging force) of about 100 N to 250 N in total pressure is applied to the nip forming member 6. By the pressure of the pressing springs 17*a* and 17*b*, the elastic layer 8*b* of the pressing roller 8 is elastically deformed, so that a nip N ((*a*) of FIG. 3) having a predetermined width is formed by the surfaces of the film 1 and the pressing roller 8.

The pressing roller 8 is rotated in an arrow direction ((*a*) of FIG. 3) by a motor M. The film 1 is rotated in an arrow direction ((*a*) of FIG. 3) by following the rotation of the pressing roller 8 while contacting the nip forming member 6 at an inner surface thereof.

In longitudinal left and right sides of the nip forming member 6, flange members 12*a* and 12*b* are mounted, respectively (FIG. 4). The flange member 12*a* performs the functions of receiving a left end of the film 1 when the film 1 moves in a longitudinal left side thereof during the rotation thereof and of limiting movement of the nip forming member 6 in the longitudinal direction. The flange member 12*b* performs the functions of receiving a right end of the film 1 when the film 1 moves in a longitudinal right side thereof during the rotation thereof and of limiting movement of the nip forming member 6 in the longitudinal direction.

The position of the flange 12*a* relative to the film 1 is limited by a limiting member 13*a*, and the position of the flange 12*b* relative to the film 1 is limited by a limiting member 13*b*. These limiting members 13*a* and 13*b* are supported by the frame.

As a material for the flanges 13*a* and 13*b*, materials having a good heat-resistant property, such as resin materials including phenolic resin, polyimide resin, polyamide resin, polyamide-imide resin, PEEK resin, PES resin, PPS resin, fluorine-containing resin, LCP (liquid crystal polymer), and mixtures of these resin materials, may preferably be used. As a material for the fluorine-containing resin, PFA, PTFE or FEP may be used.

Each of the flange members 12*a* and 12*b* also functions as an electrode member for supplying electric power to a heat generating layer 1*a*, described later, of the film 1. Onto a surface of each of the flange members 12*a* and 12*b* contacting the film 1, an electroconductive material (not shown) such as Ag is applied, so that each flange member has also the function of electrically conducting an AC current through the film 1.

The film 1 is about 10-50 mm in diameter. The film 1 is a member having a composite structure consisting of the heat generating layer 1*a* as a base layer of 30-200 μm in thickness, an elastic layer 1*b* formed on an outer surface of the heat generating layer 1*a*, and a parting layer 1*c* formed on an outer surface of the elastic layer 1*b*.

The heat generating layer 1*a* is formed by substantially uniformly dispersing carbon nanomaterial (not shown) and filament-shaped metal fine particles (not shown) in a matrix resin material of polyimide. The flange members 12*a* and 12*b* as the electrode members are contacted to end portions of the heat generating layer 1*a*, and the AC current is applied to the heat generating layer 1*a* from an AC power source A through these flange members 12*a* and 12*b*, so that energization is made with respect to a direction perpendicular to a rotational direction of the film 1, and thus the heat generating layer 1*a* generates heat. The heat of the heat generating layer 1*a* is transmitted to the elastic layer 1*b* and the parting layer 1*c*, so that the film is heated as a whole.

As shown in (*a*) of FIG. 3 and FIG 4, temperature detection of the film 1 is performed by temperature sensing elements 9, 10 and 11 which are thermistors as temperature detecting members, which are provided at positions opposing the film 1 at a side where the recording material P is fed to the fixing device 110. The temperature sensing elements 9, 10 and 11 are disposed in a longitudinal central side, a longitudinal left end side and a longitudinal right and end side, respectively, of the film 1. These (three) temperature sensing elements 9, 10 and 11 detect the film temperature at different positions with respect to a direction of a rotational axis X (FIG. 6) of the film 1.

The heat-fixing operation of the fixing device 110 in this embodiment will be described. In the fixing device 110 in this embodiment, the pressing roller 8 is rotated in the arrow direction by the motor M ((*a*) of FIG. 3) in accordance with a print instruction. The film 1 is rotated in the arrow direction by the rotation of the pressing roller 8 while contacting the nip forming member 6 at the inner surface thereof. An energization controller 304 (FIG. 8) is actuated in accordance with the print instruction. As a result, the AC current is applied to the heat generating layer 1*a* of the film 1 from an AC power source A through the flange member 12*b*, so that the heat generating layer 1*a* of the film 1 generates heat, and thus the film 1 quickly increases in temperature.

Figure 8:
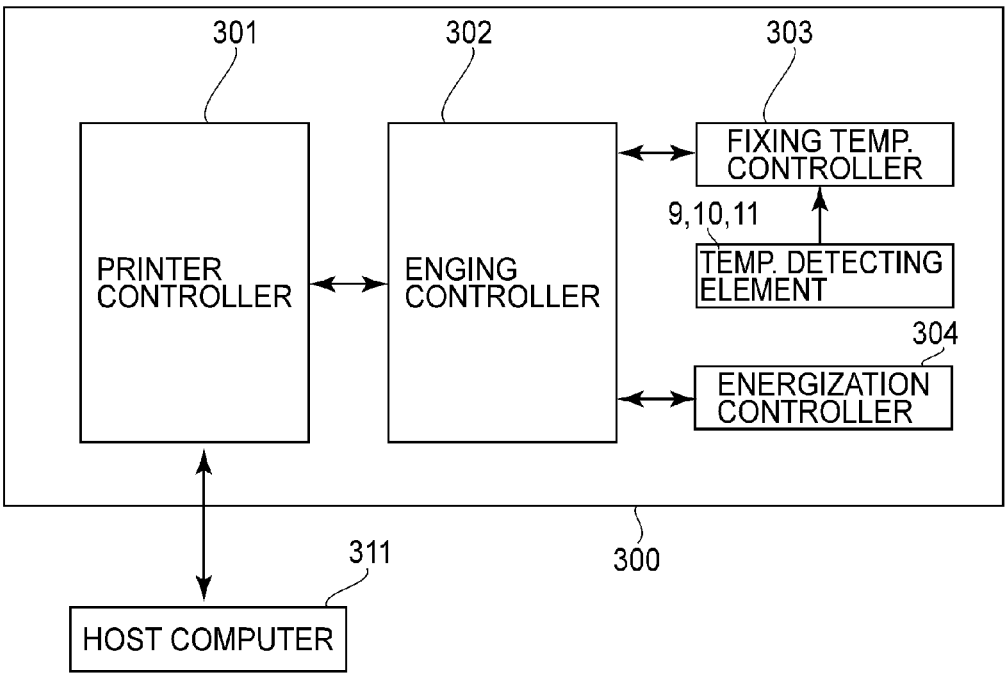
FIG. 8 is a block diagram of a printer controller of the fixing device in Embodiment 1.

Detection temperatures of the temperature sensing elements 9, 10 and 11 for monitoring the surface temperature of the film 1*a* are outputted to a fixing temperature controller 303 (FIG. 8). The fixing temperature controller 303 outputs, to an engine controller 302 (FIG. 8), the temperature detected by the temperature sensing element 9 disposed at the longitudinal central portion of the film 1. The engine controller 302 controls the energization controller 304 on the basis of the detection temperature of the temperature sensing element 9 from the fixing temperature controller 303. As a result, energization to the film 1 is performed, so that the film surface temperature is maintained and adjusted at a predetermined temperature control target temperature.

The recording material P carrying thereon the (unfixed) toner image T is nipped and fed through the nip N while heat and nip pressure are applied to the film 1, so that the toner image is heat-fixed on the recording material P.

Figure 5:
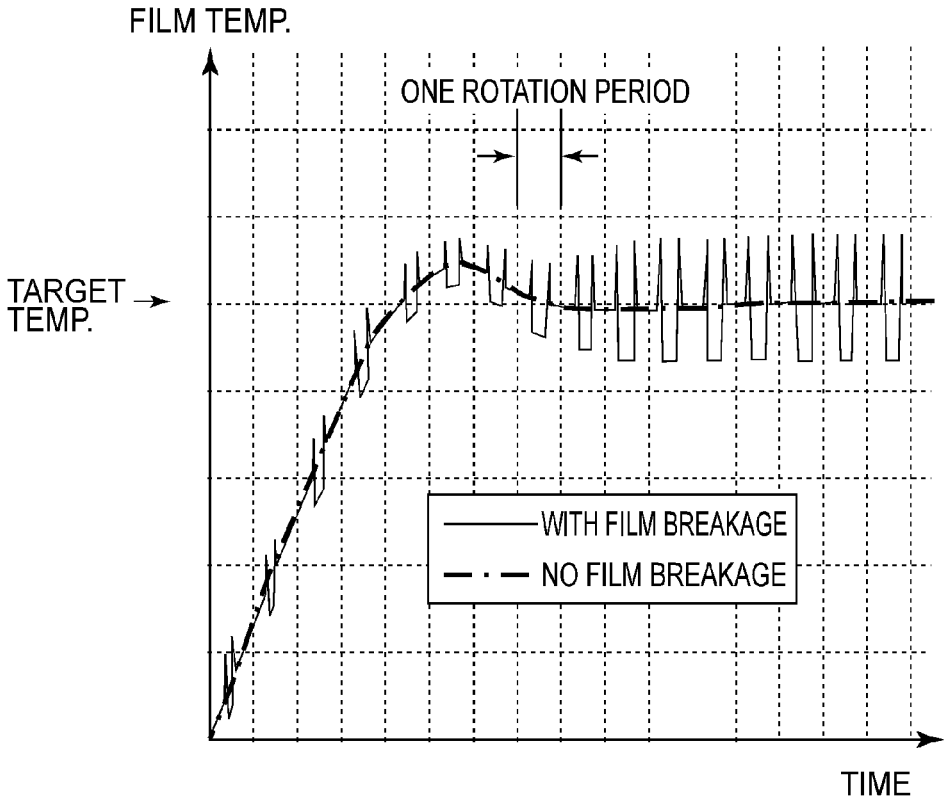
FIG. 5 is a temperature change diagram of the film in the fixing device in Embodiment 1.

(3) Temperature Change of Film (Rotatable Member) in One Rotation Period Due to Film Breakage FIG. 5 shows a temperature change of the film 1 in a process in which the fixing device 110 is actuated to increase the film temperature up to a temperature control target temperature at which the toner image T on the recording material P is fixable. The temperature change shown in FIG. 5 occurs in a state in which the film 1 is rotated by rotation of the pressing roller 8. In FIG. 5, the chain line represents the temperature change in the case where the film breakage does not occur. The solid line represents the temperature change at a film breakage end B and a film breakage end C ((*c*) and (*d*) of FIG. 6) in the case where the film breakage occurs so as to block the path of a current flowing into the film 1.

As is apparent from FIG. 5, there is no abrupt change in the case where there is no film breakage (chain line), whereas the degree of change in the film surface temperature is large depending on one rotation period of the film 1.

Figure 6:
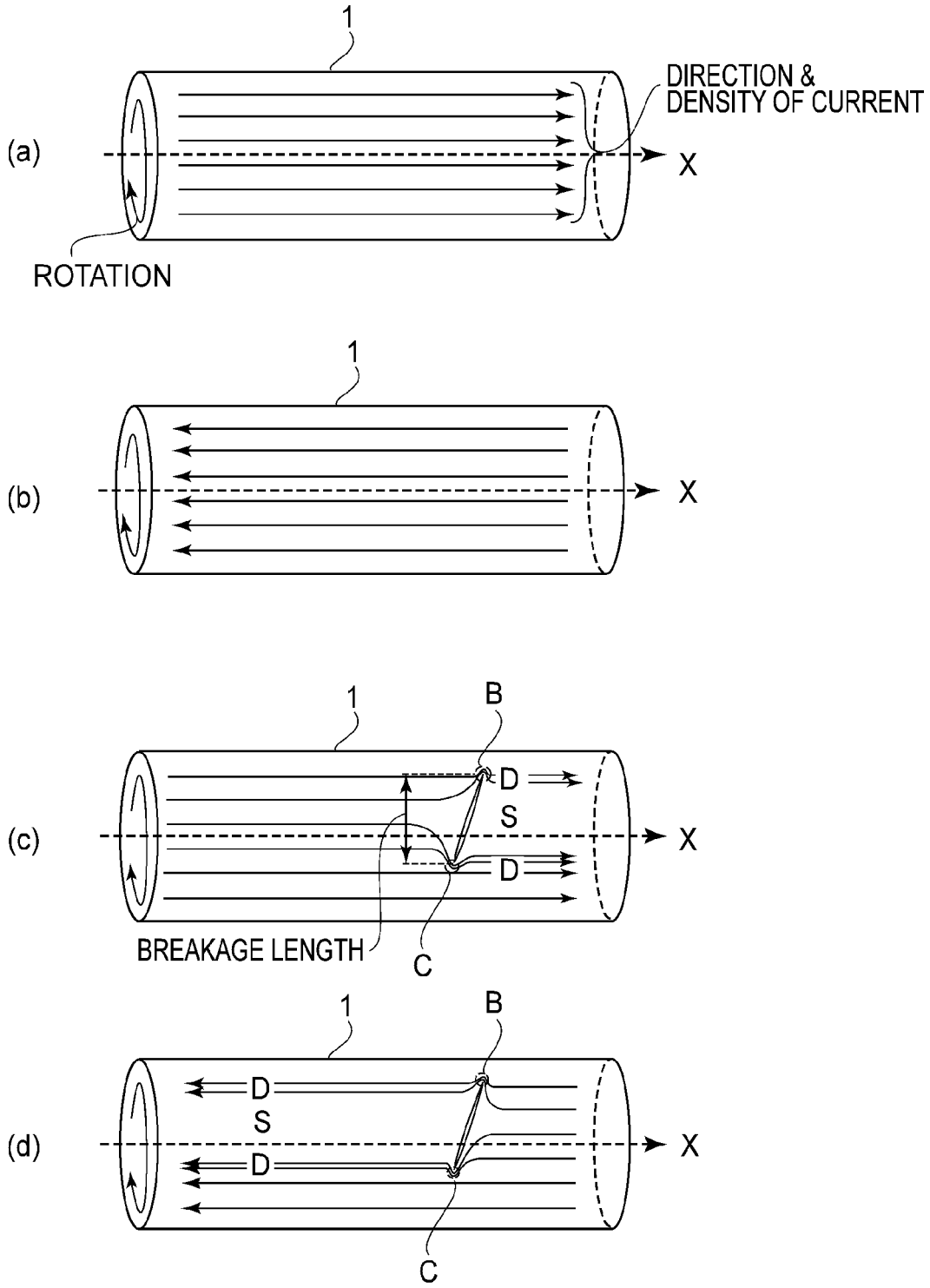
In FIG. 6, (*a*) to (*d*) are schematic views for illustrating an abnormal temperature increase phenomenon in the case where film breakage exists.

In FIG. 6, (*c*) and (*d*) are schematic views for illustrating a phenomenon such that the film surface temperature fluctuates in one rotation period of the film 1 in the case where the film breakage exists. In (*c*) and (*d*) of FIG. 6, arrows represent the current direction and the current density. One rotation period of the film refers to a period in which the film 1 rotates through one full circumference (one full turn).

As described above, by the application of the AC current to the film 1 via the flange members 12*a* and 12*b*, as shown in (*a*) and (*b*) of FIG. 6, the AC current flows into the film 1 in a direction perpendicular to the rotational direction of the film 1. However, as shown in (*c*) and (*d*) of FIG. 10, in the case where the film breakage occurs, at the film breakage end B or C, the flowing current circumvents the direction perpendicular to the film rotational direction, so that the current concentrates at these film breakage ends.

As shown in (*c*) of FIG. 6, in the case where the current flows from left to right in the direction perpendicular to the rotational direction of the film 1, the current passing through the film breakage end B or C is not returned to the original path, but passes through a path close to the right-side electrode member, which is low in resistance, i.e., the unshown flange member 12*b*. For that reason, in a region from the neighborhood of the film breakage end B or C to the flange member 12*b*, the current density becomes high (dense ("D") state). On the other hand, in a region from the neighborhood of the neighborhood of the film breakage end B or C to the left side electrode member, i.e., the unshown flange member 12*a*, the current density becomes low (sparse ("S") state). As shown in (*d*) of FIG. 6, in the case where the current flows from right to left in the direction perpendicular to the film rotational direction, the current density with respect to the rotational direction is in the same state as that in (*c*) of FIG. 6.

Accordingly, when the times of the respective one rotation periods of the film 1 are averaged, over a full longitudinal region of the film 1 where the film breakage occurs, the film 1 includes a local heat generating portion and a portion where the current density becomes low due to the circumvention of the current and thus the film surface temperature becomes low. As a result, as described above, in the one rotation period of the film, the film surface temperature fluctuates in the full longitudinal region.

Figure 7:
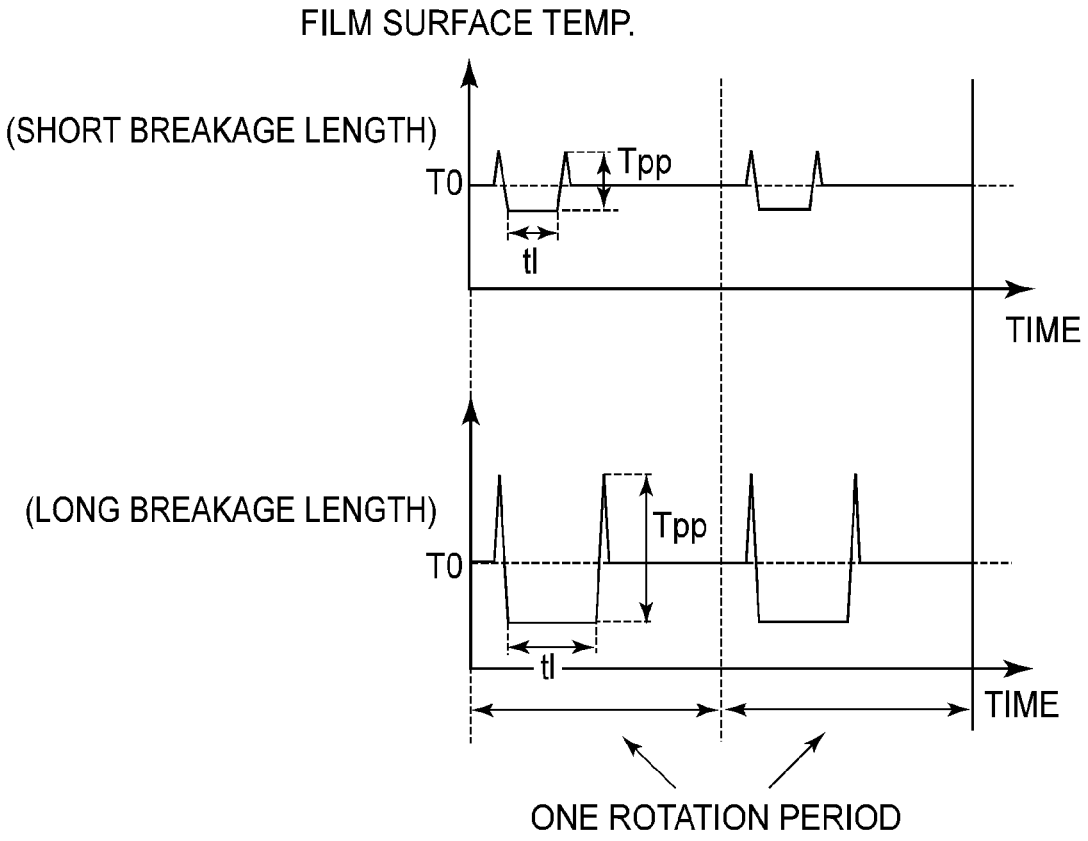
FIG. 7 is an illustration showing a change in film surface temperature depending on a difference in length of the film breakage.

Next, a film breakage detecting method based on the temperature change in the one rotation period of the film in this embodiment will be described. FIG. 7 is schematic view showing the difference in surface temperature of the film 1 depending on the size (length) of the film breakage by a time corresponding to the full turns of the film 1. In FIG. 7, the distance between the film breakage ends B and C with respect to the rotational direction of the film 1 shown in (*c*) of FIG. 6 was used as a breakage length.

As is apparent from FIG. 7, in the case where the breakage length is long, compared with the case where the breakage length is short, a time t1 (in the figure in which the film surface temperature is lower than a reference temperature T0 in the case where there is no film breakage becomes long. This is because, with respect to the longitudinal direction of the film 1, of the current flowing from both ends of the film 1 shown in (*c*) and (*d*) of FIG. 6 in the direction perpendicular to the film rotational direction, the circumvented current increases with a longer breakage length. This is because, with respect to a circumferential direction of the film 1, a low current density region increases.

In the case where the breakage length is long, the temperature change amount Tpp (FIG. 7 ) of the film 1 becomes large. This is because with an increase in circumvented current, the current density at the film breakage ends B and C increases.

By using the above-described characteristic, in the fixing device 110 in this embodiment, in the case where the temperature change amount Tpp in the one rotation period of the film is larger than a predetermined amount (predetermined value), the controller discriminates that there is a possibility that the image defect is caused. Then, the controller stops the energization to the film 1 and provides a notification for urging a user to exchange the device (abnormality notification of the device). Alternatively, in the case where the time t1 (FIG. 7) in which the film surface temperature is lower than the reference temperature T0 in the one rotation period of the film is longer than a predetermined time (predetermined value), the controller discriminates that there is a possibility that the image defect is caused. Then, the controller stops the energization to the film 1 and provides a notification for urging the user to exchange the device (abnormality notification of the device).

FIG. 8 is a block diagram of a printer control portion 300. In the printer control portion 300, a printer controller 301 effects communication and image data reception between itself and a host computer 311, and develops the image data into printable information. Further, the printer controller 301 effects transmission and reception of signals and signal communication between itself and an engine controller 302 as a controller.

The engine controller 302 effects transmission and reception of signals between itself and the printer controller 301, and controls a fixing temperature controller 303 and an energization controller 304 via serial communication.

The fixing temperature controller 303 not only controls the temperature of the film 1 on the basis of a temperature detected by the temperature sensing element 9, but also detects an abnormal temperature of the film 1. The energization controller 304 controls electric power to the applied to the film 1 by adjusting the input voltage of the AC power source A.

In a printer system including such a printer control portion 300, the host computer 311 transfers the image data to the printer controller 301, and obtains durable lifetime information and warning information of the device from the printer controller 301. The printer system includes the image forming apparatus 100 and the host computer 311, which is capable of communicating with the image forming apparatus 100.

Figure 1:
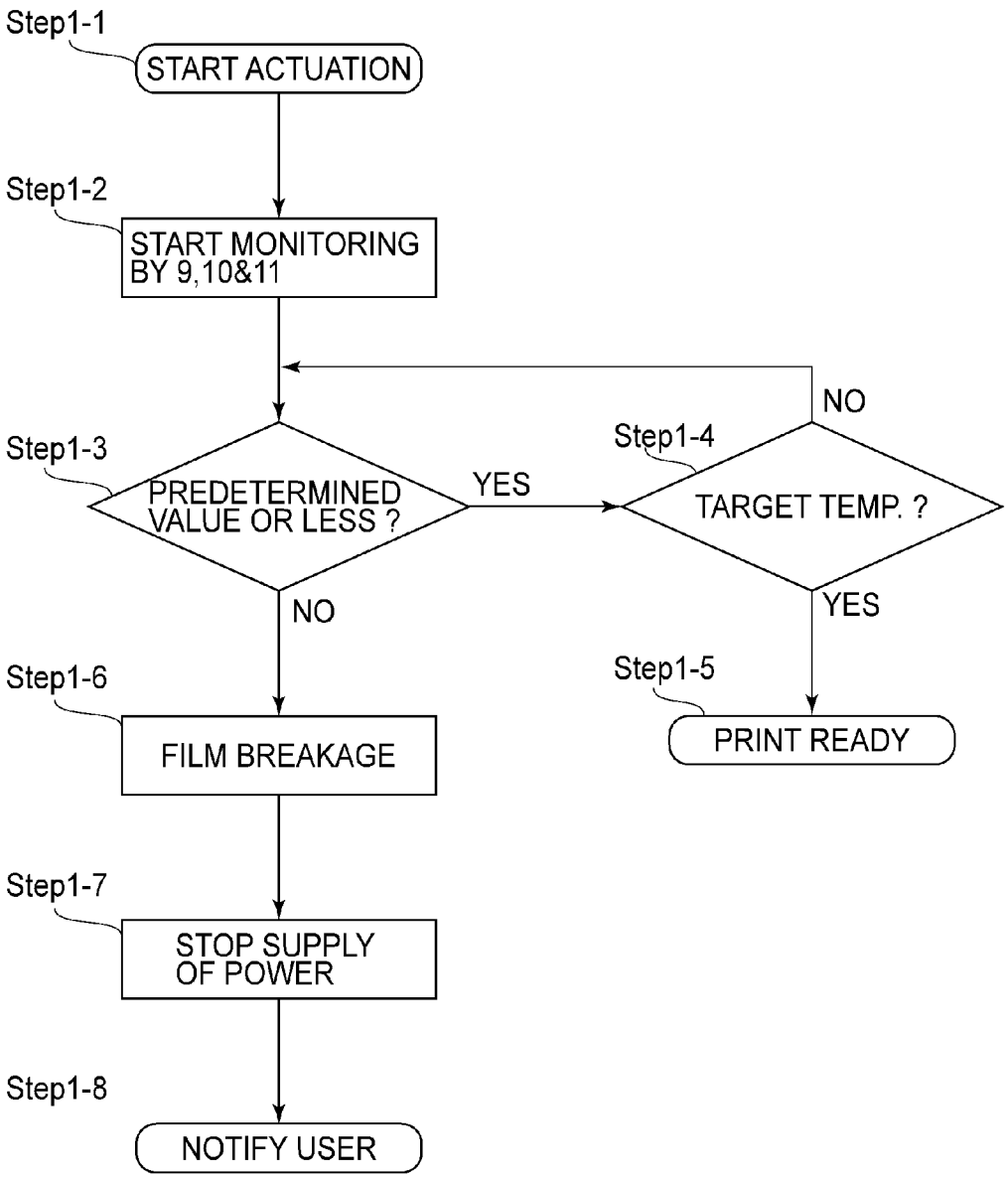
FIG. 1 is a flowchart showing a film detecting method of a fixing device and an operation of an image forming apparatus in Embodiment 1.

FIG. 1 is a flowchart showing a film breakage detecting method of the fixing device 110 and an operation of the image forming apparatus 100 in the case where the film breakage is detected in this embodiment. A series of processes in Step 1-1 to Step 1-8 shown in FIG. 1 is stored as a film breakage detecting sequence in an unshown memory, such as ROM or RAM, and is carried out by the engine controller 302 during the actuation of the fixing device 110 before the film surface temperature reaches the temperature control target temperature.

(Step 1-1)

On obtaining of a print instruction (command) by the printer controller, the engine controller 302 not only drives the motor M, but also starts an actuating operation of the fixing device 110 so that the film surface temperature reaches the temperature control target temperature.

(Step 1-2)

The fixing temperature controller 303 starts, simultaneously with the start of the actuating position of the fixing device 110, monitoring of the temperature change amount in the one rotation period of the film by the temperature sensing elements 9, 10 and 11 disposed at the longitudinal central portion, the longitudinal left end portion and the longitudinal right end portion, respectively, of the film 1.

There is a possibility that the one rotation period of the film deviates from an ideal time, due to a speed change of the motor M rotationally driving the pressing roller 8 and a speed change caused by the eccentricity of the pressing roller 8 or the member 1. Alternatively, there is a possibility that the one rotation period of the film deviates from the ideal time due to a change in frictional force between the pressing roller 8 and the film 1 in one full circumference of the film 1 and a change in rotational speed of the film 1. In these cases, the one rotation period of the film is a time in which an amount of the deviation from the ideal time for the one rotation period of the film is taken into consideration, and there is no need to strictly define the one rotation period of the film.

(Step 1-3)

The engine controller 302 discriminates whether or not the change amount in the one rotation period of the film is the predetermined value or less. The change amount in the one rotation period of the film is computed by the fixing temperature controller 303 on the basis of the temperature change detected by the temperature sensing elements 9, 10 and 11. In the case where the change amount (Tpp in FIG. 7) in the one rotation period of the film is larger than the predetermined value with respect to either one of the temperature sensing elements 9, 10 and 11, the sequence goes to Step 1-6. In the case where the change amount (Tpp in FIG. 7) in the one rotation period of the film is the predetermined value or less, the sequence goes to Step 1-4. Alternatively, the time (t1 (change amount in FIG. 7) in which the film surface temperature is lower than the reference temperature T0 in the one rotation period of the film is longer than the predetermined time (predetermined value) with respect to either one of the temperature sensing elements 9, 10 and 11, the sequence goes to Step 1-6. In the case where the time (T1 in FIG. 7) in the one rotation period of the film is the predetermined time (predetermined value) or less, the sequence goes to Step 1-4. The time t1 is a time in which the film surface temperature lower than the reference temperature T0 in the one rotation period of the film is maintained.

(Step 1-4)

In the case where the change amount in the one rotation period of the film is the predetermined value or less, the toner controller 303 discriminates whether or not the detection temperature of the film 1 by the temperature sensing element 9 disposed at the longitudinal central portion reaches the temperature control target temperature. In the case where the detection temperature does not reach the temperature control target temperature, the sequence returns to Step 1-3.

(Step 1-5)

In the case where the change amount in the one rotation period of the film is the predetermined value or less and where the detection temperature by the temperature sensing element 9 reaches the temperature control target temperature, the controller discriminates that the fixing device b110 is in a printable state, and notifies an unshown image forming apparatus 100 controller of a "PRINT READY" status.

(Step 1-6)

In the case where the change amount in the one rotation period of the film is larger than the predetermined value in Step 1-3, the fixing temperature controller 303 discriminates that a film breakage occurs, creating the possibility that an image defect is caused, and then notifies the engine controller 302 of that effect.

(Step 1-7)

In the case where the fixing temperature controller 303 discriminates that the film breakage occurs, the engine controller 302 immediately stops the supply of electric power from the energization controller 304 to the film 1.

(Step 1-8)

The printer controller 301 notifies the user of an abnormality of the fixing device 110 via the host computer 311. Alternatively, the printer controller 301 notifies the user of the abnormality of the fixing device 110 via an operation panel provided on the image forming apparatus main assembly 100A.

As described above, the fixing device 110 includes the plurality of the temperature sensing elements 9, 10 and 11 disposed along the longitudinal direction of the film 1, and monitors the temperature change amount in the one rotation period of the film on the basis of each of detection temperatures by these temperature sensing elements. Then, in the case where the temperature change amount in the one rotation period of the film is larger than the value, the controller discriminates that the film breakage occurs. In the case where the controller discriminates that the film breakage occurs, before the film breakage causes an image defect such as image non-uniformity or hot offset, the electric power supply to the film 1 is stopped or the user is notified of the abnormality of the device, and therefore it is possible to improve the performance of the image forming apparatus 100.

[Embodiment 2]

Another example of the fixing device 110 will be described. The fixing device 110 in this embodiment is a device of an electromagnetic induction heating type in which the (unfixed) toner image carried on the recording material P is heat-fixed on the recording material P by heat of a cylindrical film (sleeve) 21 generating heat through electromagnetic induction heating.

(1) Fixing Device 110

Figure 9:
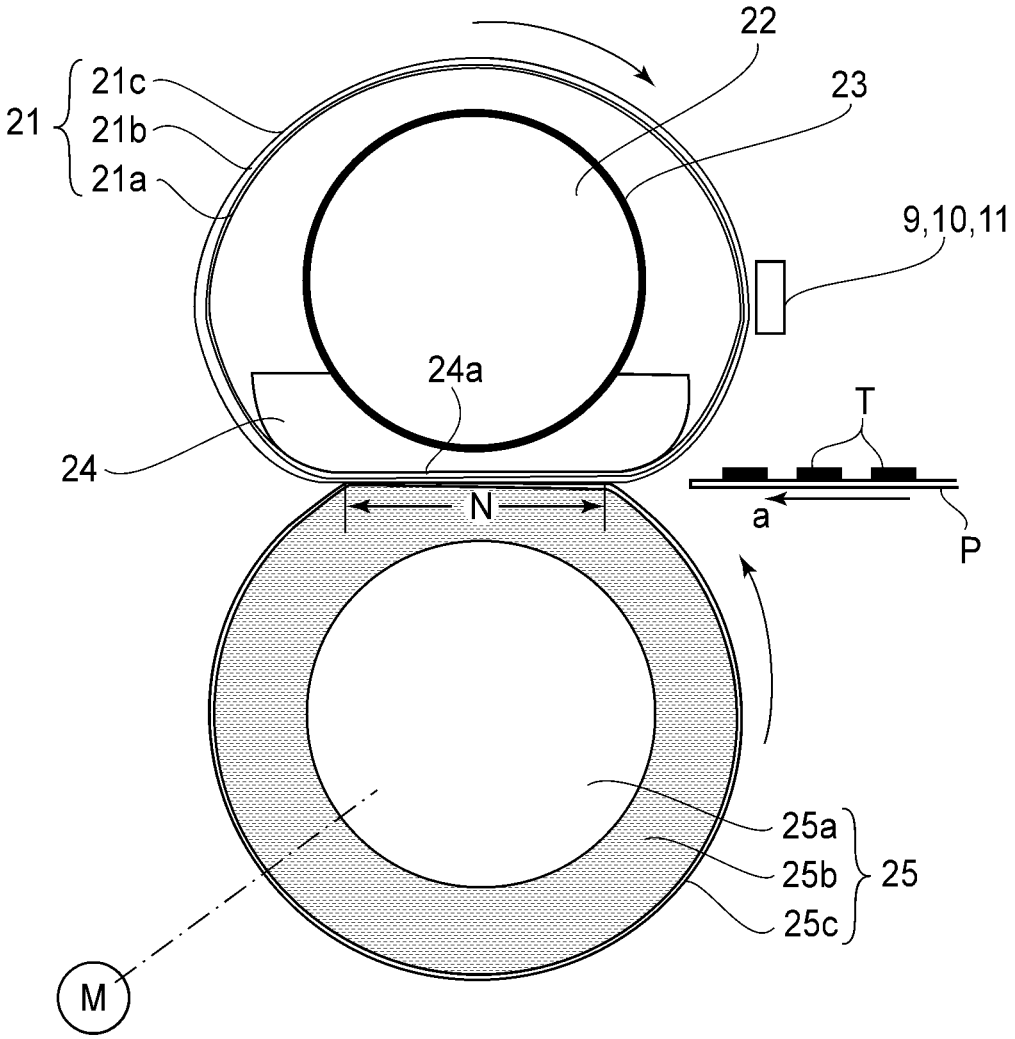
FIG. 9 is a sectional view of a fixing device in Embodiment 2.
Figure 10:
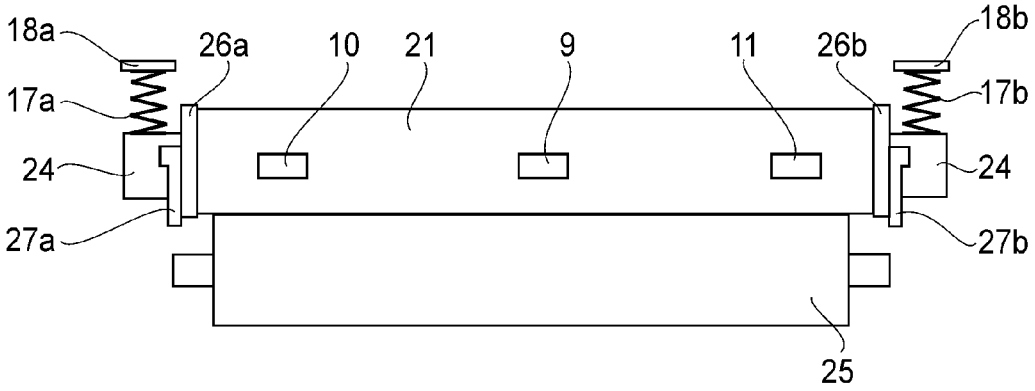
FIG. 10 is a front view of the fixing device in Embodiment 2.

In FIG. 9 is a sectional view showing a general structure of an example of the fixing device 110 of an electromagnetic induction heating type in this embodiment. FIG. 10 is a front view of the fixing device 110 (FIG. 9 ) as seen from a recording-material-feeding side.

The fixing device 110 in this embodiment includes a cylindrical film 21 as a cylindrical rotatable member, a nip forming member 24 and a pressing roller 25 as a pressing member (opposing member). Further, the fixing device 110 includes, inside the film 21, a magnetic core 22 as a magnetic core material and an exciting coil 23 as a magnetic field generating means.

The nip forming member 24 is formed of the heat-resistance resin material. The nip forming member 24 is inserted into the film 21 and forms a nip N in combination with the pressing roller 25 at a flat surface 24*a* in a pressing roller 25 side where the nip forming member 24 contacts an inner surface of the film 21.

The film 21 has a cylindrical shape of 10 mm to 50 mm in diameter. The layer structure of the film 21 is a composite structure consisting of a heat generating layer 21*a* formed as a base layer of an electroconductive member, an elastic layer 21*b* formed on an outer surface of the heat generating layer 21*a*, and a parting layer 21*c* formed on an outer surface of the elastic layer 21*b*. As a material for the heat generating layer 21*a*, SUS of 20 μm to 100 μm in thickness was used. The fixing device 110 in this embodiment has a constitution in which a magnetic path is formed so as to extend around the film 21 in a circumferential direction of the film 21 as described later, and therefore it is possible to use, as the heat generating layer 21*a*, thin magnetic metal or thin non-magnetic metal which does not constitute the magnetic path.

On the outer surface of the heat generating layer 21*a*, as the elastic layer 21*b*, a layer of silicone rubber was molded in a thickness of 0.1 mm to 0.3 mm so as to have a hardness of 20 degrees (JIS-A hardness under application of a load of 1 kg). On the outer surface of the elastic layer 21*b*, as the parting layer (surface layer) 21*c*, a fluorine-containing resin tube was coated in a thickness of 10 μm to 50 μm.

Figure 11:
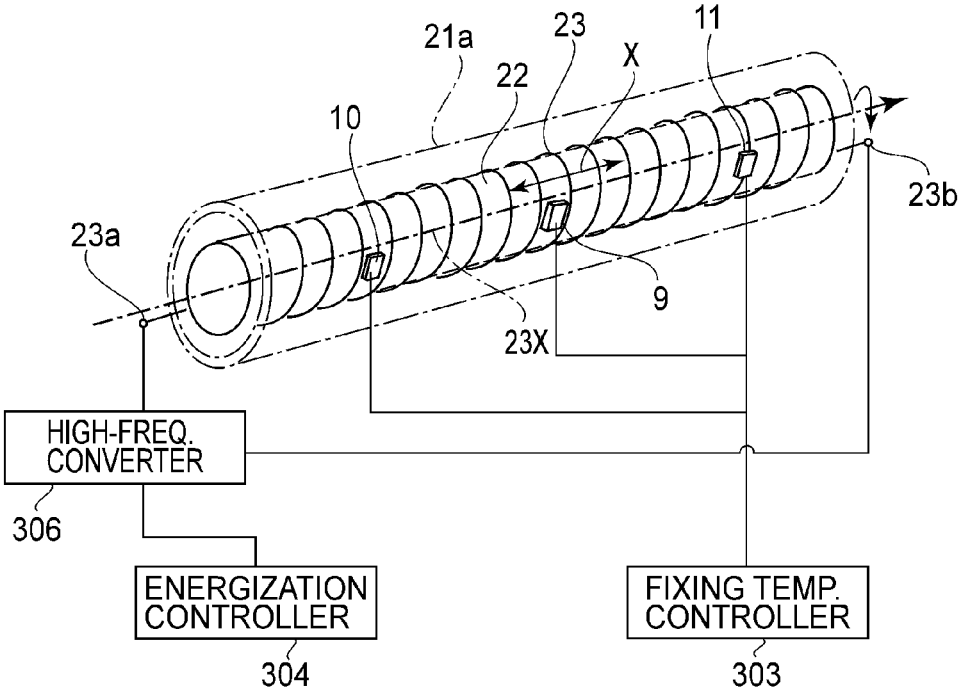
FIG. 11 is a perspective view of a heat generating layer of the film, a magnetic core and an exciting coil of the fixing device in Embodiment 1.

FIG. 11 is a perspective view showing a positional relationship among the heat generating layer 21*a*, the magnetic core 22 and the exciting coil 23 of the film 21 in the fixing device 110 in this embodiment.

As shown in FIG. 11, the magnetic core 22 formed in a cylindrical shape is provided and fixed by an unshown fixing means at a substantially central portion in cross section with respect to a short direction (parallel to the feeding direction a of the recording material P) of the film 21. The magnetic core 22 induces magnetic lines of force (magnetic fluxes), by the AC magnetic field generated by the exciting coil 23, into (the inside of) the film 21, and functions as a member for forming a path (magnetic path) of the magnetic lines of force.

The magnetic core 22 may preferably be formed of a material having small hysteresis loss and high relative permeability. As the material for the magnetic core 22, ferromagnetic materials constituted by high-permeability oxides or alloy materials such as calcined ferrite, ferrite resin, amorphous alloy and permalloy may preferably be used. It is desirable that the diameter of the magnetic core 22 has a large cross-sectional area to the possible extent within a range in which the magnetic core 22 is accommodatable in the film 21, and in this embodiment, the diameter of the magnetic core 22 was 5 mm to 40 mm. The shape of the magnetic core 22 is not limited to the cylindrical shape, but can be selected from other shapes, such as a polygonal prism shape.

In this embodiment, the magnetic core 22 is constituted to form an open magnetic path by being disposed only inside the film 21, but in a modified embodiment, a closed magnetic path is formed by disposing the magnetic core also around the film so as to extend along a circumferential direction of the film.

The exciting coil 23 is formed by winding a single lead wire of a heat-resistant polyamide-coated copper wire material of 1 to 2 mm in diameter around the magnetic core 22 inside the film in a winding number of about 10 to about 30 with respect to a direction crossing a film rotational axis X. A helical axis 23X of the exciting coil 23 is substantially parallel to the rotational axis X of the film 21. The helical axis 23X refers to a winding center of the lead wire of the exciting coil 23. In this embodiment, the exciting coil 23 is constituted by the winding having a winding number of 18.

As described above, inside the film 21, the exciting coil 23 is formed by winding the single lead wire around the magnetic core 22 in the direction crossing the direction of the film rotational axis X. For this reason, when a high-frequency current (AC current) is caused to flow into the exciting coil 23 via energization contact portions 23*a* and 23*b*, the magnetic field is generated in a direction parallel to the direction of the rotational axis X of the film 21. That is, the magnetic core 22 for inducing the magnetic field in the direction of the film rotational axis X is disposed in the exciting coil 23, which is disposed inside the film 21 and whose helical axis 23X extends in the direction of the rotational axis X of the film 21.

The pressing roller 25 is a member having an outer diameter of 30 mm, including a metal core 25*a*, an elastic layer 25*b* formed on an outer surface of the core metal 25*a* in a region between longitudinal end shaft portions of the core metal 25*a*, and a parting layer 25*c* formed on the outer surface of the elastic layer 25*b*.

As shown in FIG. 10, in longitudinal left and right sides of the nip forming member 24, flange members 26*a* and 26*b* are mounted, respectively. The flange member 26*a* performs the functions of receiving a left end of the film 21 when the film 21 moves in a longitudinal left side thereof during the rotation thereof and of limiting movement of the nip forming member 24 in the longitudinal direction. The flange member 26*b* performs the functions of receiving a right end of the film 21 when the film 21 moves in a longitudinal right side thereof during the rotation thereof and of limiting movement of the nip forming member 24 in the longitudinal direction.

A position of the flange member 26*a* relative to the film 21 is limited by a limiting member 27*a*, and a position of the flange member 26*b* relative to the film 1 is limited by a limiting member 27*b*. These limiting members 13*a* and 13*b* are supported by an unshown frame of the device.

In the fixing device 110 in this embodiment, the longitudinal left and right end portions of the nip forming member 24 are supported by the frame, and also a shaft portion of the core metal 25*a* of the pressing roller 25 is rotatably supported by the frame via bearings (not shown). Further, the nip forming member 24 is pressed in a direction perpendicular to a generatrix direction of the pressing roller 25 by pressing springs 17*a* and 17*b* compressedly provided between the nip forming member 24 and spring receiving members 18*a* and 18*b* of the frame at the left and right end portions of the nip forming member 24.

In this embodiment, a pressure of about 98 N to about 196 N (about 10 kgf to about 20 kgf) in total pressure is applied to the nip forming member 24. At this pressure, a flat surface 24*a* of the nip forming member 24 is pressed against the surface of the pressing roller 25 via the film 21. As a result, the elastic layer 25*b* of the pressing roller 25 is elastically deformed, so that a nip N having a predetermined width is formed by the surfaces of the film 21 and the pressing roller 25.

A heat-fixing operation of the fixing device 110 in this embodiment will be described. In the fixing device 110 in this embodiment, the pressing roller 25 is rotated in the arrow direction by the motor in accordance with a print instruction (FIG. 9). The film 21 is rotated in the arrow direction by the rotation of the pressing roller 8 while contacting the flat surface 24*a* of the nip forming member 24 at the inner surface thereof. The energization controller 304 actuates a high-frequency converter 306 as a temperature controller in accordance with the print instruction, and the high-frequency converter 306 supplies a high-frequency current to the exciting coil 23 via the energization contact portions 23*a* and 23*b*. As a result, the heat generating layer 21*a* of the film 21 generates heat through electromagnetic induction heating, and thus the film 21 quickly increases in temperature.

Output signals of the temperature sensing elements 9, 10 and 11 for monitoring the surface temperature of the film 21 are outputted to the fixing temperature controller 303. The fixing temperature controller 303 outputs, to an engine controller 302 (FIG. 8), the temperature detected by the temperature sensing element 9 disposed at the longitudinal central portion of the film 21. The engine controller 302 controls the energization controller 304 on the basis of the detection temperature of the temperature sensing element 9 from the fixing temperature controller 303. The energization controller 304 controls the high-frequency converter 306. As a result, the film surface temperature is maintained and adjusted at a predetermined temperature control target temperature.

The recording material P carrying thereon the (unfixed) toner image T is nipped and fed through the nip N while heat and nip pressure are applied to the film 21, so that the toner image is heat-fixed on the recording material P.

Figure 12:
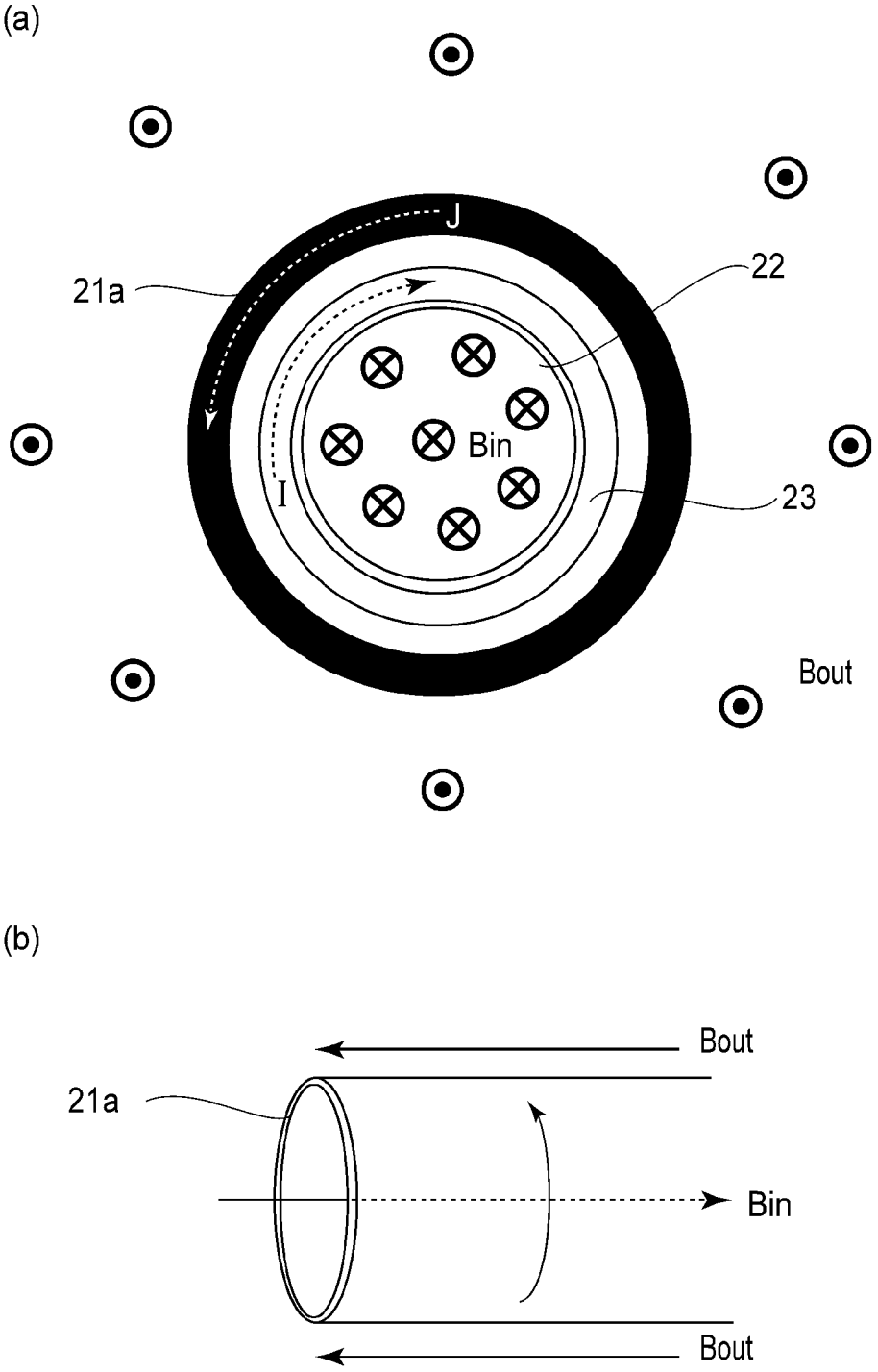
In FIG. 12, (*a*) and (*b*) are schematic views for illustrating a heat generation principle of the heat generating layer.

The heat generation principle of the film 21 will be described with reference to FIG. 12. In FIG. 12, (*a*) is a schematic view showing a current passing through the film 21 and a magnetic field generated in the film 21 in cross section with respect to a short direction of the heat generating layer 21*a*. In FIG. 12, (*b*) is a schematic view showing a current passing through the film 21 with respect to the longitudinal direction of the heat generating layer 21*a*.

In (*a*) of FIG. 12, from the center of the film 21, the magnetic core 22, the exciting coil 23 and the heat generating layer 21*a* are concentrically disposed. The magnetic lines of force indicated by arrows toward a depth direction on the drawing sheet are represented by "Bin" (x in ○), and the magnetic lines of force indicated by arrows toward a front direction on the drawing sheet are represented by "Bout" (• in ○).

At the instant when the current increases in the exciting coil 23 with respect to an arrow I direction, the magnetic lines of force are formed in the magnetic path as indicated by the arrows toward the depth direction on the drawing sheet. That is, the number of the magnetic lines of force "Bin" passing through the magnetic core 22, inside the heat generating layer 21*a*, in the depth direction is 8, and also the number of the magnetic lines of force "Bout" returning toward the front direction outside the heat generating layer 21*a* is 8. When the AC magnetic field is formed in actuality, an indicated electromotive force is exerted over a full circumferential region of the heat generating layer 21*a* so as to cancel the magnetic lines of force which are formed as described above, so that the current passes through the film 21 so as to move in the circumferential direction of the film 21 as indicated by an arrow J (hereinafter, referred to as a circumferential direction current).

The indicated electromotive force is exerted in a circumferential direction of the heat generating layer 21*a*, and therefore the circumferential direction current J uniformly flows inside the heat generating layer 21*a*. The magnetic lines of force generated by the magnetic core 22 repeats generation and extinction and direction reversal by the high-frequency current, and therefore the circumferential direction current J flows in synchronisms with the high frequency current while repeating the generation and extinction and the direction reversal. When the current flows into the heat generating layer 21*a*, due to the electric resistance of the material (metal) for the heat generating layer 21*a*, Joule heat is generated in the heat generating layer 21*a*.

The Joule heat generation is called "iron loss (core loss)" in general, and the heat generation amount Pe is represented by the following formula (1):

$$P_e = k_e \frac{(tfB_m)^2}{\rho} \quad (1)$$

Pe: heat generation amount
t: film thickness
f: frequency
Bm: maximum magnetic flux density
ρ: resistivity
ke: constant of proportionality The magnetic lines of force generated by the magnetic core 22 generated in parallel to the direction of the rotational axis X (FIG. 11) of the film 21, and therefore the circumferential direction current J flows in the circumferential direction perpendicular to the film rotational axis direction.

The circumferential direction current J generated as described above depends on the magnetic flux in the magnetic core 22 and the resistance value of the heat generating layer 21*a*, but is independent of the magnetic flux density of the heat generating layer itself. For that reason, even when the heat generating layer 21*a*, which is formed of magnetic or non-magnetic metal in a small thickness and which does not constitute the magnetic path, is used, the heat generating layer 21*a* can generate heat at a high efficiency. Further, in a range of the resistance value of the heat generating layer 21*a*, the circumferential direction current J is also independent of the thickness of the material for the heat generating layer 21*a*. Further, even in the case where as the material for the heat generating layer 21*a*, an electroconductive resin material or the like other than the metal material is used, it is possible to cause the heat generating layer 21*a* to generate heat.

That is, in the film 21 in this embodiment, an induced current is generated in the heat generating layer 21*a* with respect to the circumferential direction by passing the high-frequency current through the exciting coil 23, so that the heat generating layer generates the heat by this induced current.

Device constitutions other than those described above in the fixing device 110 in this embodiment are the same as those in Embodiment 1, and therefore a detailed description thereof will be omitted.

Figure 13:
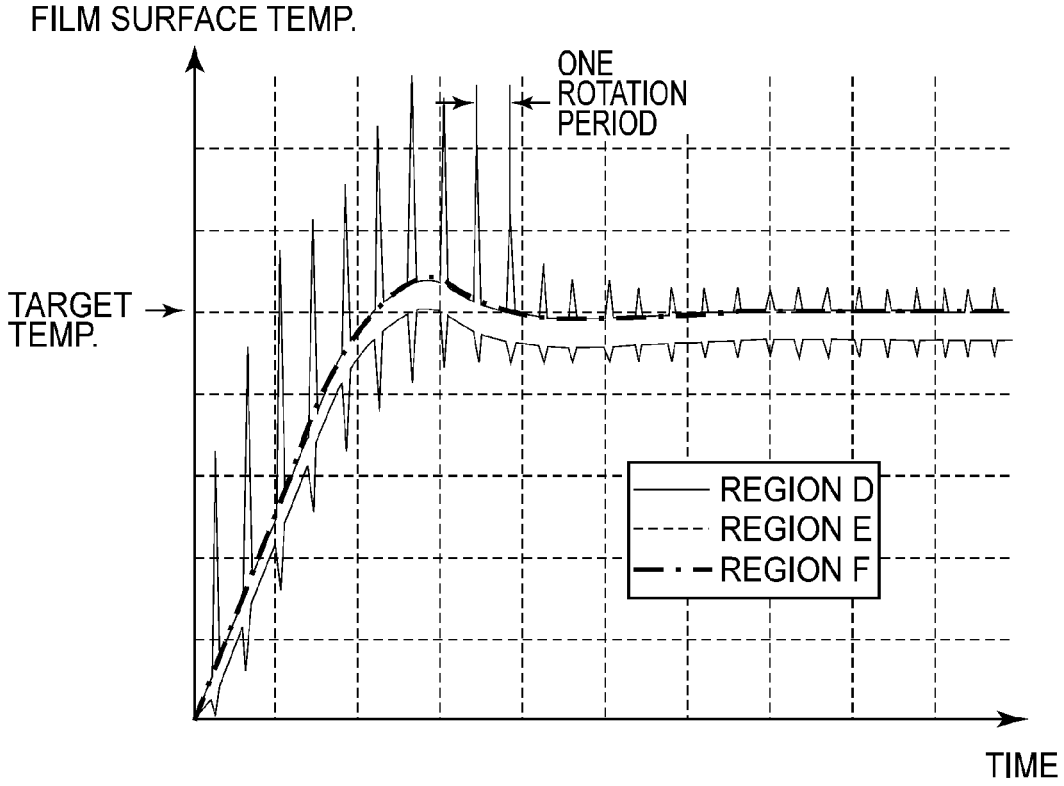
FIG. 13 is a temperature change diagram of a film in the fixing device in Embodiment 2.
Figure 14:
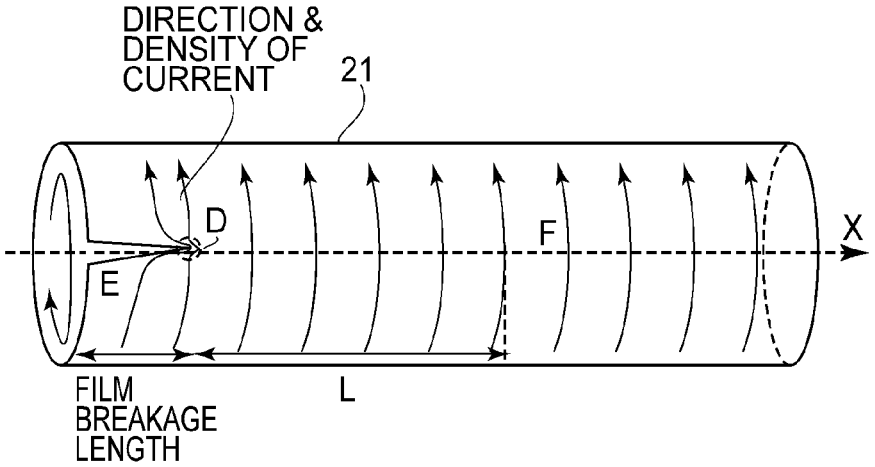
FIG. 14 is a schematic view for illustrating an abnormal temperature increase phenomenon in the case where film breakage exits.

FIG. 13 shows a temperature change of the film 21 in a process in which the fixing device 110 is actuated to increase the film temperature up to a temperature control target temperature at which the toner image T on the recording material P is fixable. Similarly as in Embodiment 1, the temperature change shown in FIG. 13 is that in a state in which the film 1 is rotated by rotational of the pressing roller 25. FIG. 14 is a schematic view for illustrating a phenomenon such that the film surface temperature fluctuates in one rotation period of the film 21 in the case where the film breakage occurs so as to block the current flowing into the film 21. In FIG. 14, arrows represent current direction and a current density. The film 21 has a rotational axis X.

With reference to FIGS. 13 and 14, the temperature change of the film 21 in the one rotation periodof the film due to the film breakage of the film 21 in the fixing device 110 in this embodiment will be described.

In the fixing device 110 in this embodiment, the direction of the current flowing into the film 21 is different from that in Embodiment 1 as shown in FIG. 14, and is parallel to the film rotational direction. However, in actuality, the AC current is applied, and therefore a current flowing in a direction opposite to the arrows exists. For that reason, as shown in FIG. 14, the circumferential direction current flowing in the film rotational direction concentrates at a film breakage end D in the case where the film breakage occurs with respect to the direction of the rotational axis X of the film 21, so that the heat is generated locally at the film breakage end D. Also, the temperature distribution of the film 21 is different from that in Embodiment 1.

In the fixing device 110 in Embodiment 1, the temperature change is generated over the entire longitudinal of the film 1 in the neighborhood of the film breakage end B and the film breakage end C in the case where the film 1 causes the film breakage. On the other hand, in the fixing device 110 in this embodiment, due to a difference in the direction of the current flowing into the film between the film 21 in this embodiment and the film 1 in Embodiment 1, in a region sufficiently spaced from the film breakage portion of the film 21 with respect to the longitudinal direction, the film temperature is not influenced by the film breakage.

A chain line shown in FIG. 13 represents a temperature change in a region, as in a region F in FIG. 14, which is sufficiently spaced from a region (region E shown in FIG. 14) where the film breakage occurs with respect to the longitudinal direction of the film 21. A solid line in FIG. 13 represents a temperature change at the film breakage end D (region D) in FIG. 14 in the case where the film breakage occurs with respect to the direction of blocking the current flowing into the film 21. A broken line in FIG. 13 represents a region, as a region E in FIG. 14, where the film breakage occurs.

As is apparent from FIG. 13, at the film breakage end (region D, solid line), the degree of change in the film surface temperature is large depending on the one rotation period of the film 21. In the region (region E, broken line) where the film occurs, by the influence of the circumferential direction current circumventing the film breakage end D shown in FIG. 14, the film surface temperature is lower than that in the region (region F, chain line) sufficiently spaced from the region where the film breakage occurs. Further, in the region where the film breakage occurs, the electric power cannot be supplied, and therefore the film surface temperature fluctuates toward a low-temperature side depending on the one rotation period of the film.

As an experimental example, a result of measurement of the temperature change amount in the one rotation period of the film is shown. An experiment was conducted under a condition of 160° C. in temperature control target temperature, 1000 W in supplied maximum electric power and 210 mm/sec in film rotational speedby using a film of 30 mm in diameter and 240 mm in length.

Table 1 appearing hereinafter shows the result of measurement of the temperature change amount in the one rotation period of the film depending on a film breakage length (FIG. 14) until the film surface temperature reaches the temperature control target temperature and depending on a distance L (FIG. 14) from the film breakage end D. The temperature change amount in the one rotation period of the film is a difference, at a position sufficiently spaced from the film breakage end D, between an average temperature, as a reference temperature, of film surface temperatures each in the one rotation period of the film and a maximum temperature in the one rotation period of the film at each of associated positions shown in Table 1. The position sufficiently spaced from the film breakage end D is the position of the temperature sensing element 9, provided at the longitudinal central portion, spaced from the film breakage end D by 120 mm. That is, Table 1 represents the change in temperature increased due to a factor other than the temperature provided by the heat generation of the film 21 during normal actuation of the fixing device.

TABLE 1

| | FBL*1 | TEMPERATURE CHANGE*2 (° C.) LONGITUDINAL DISTANCE L*3 (mm) | | | | |
|---|---|---|---|---|---|---|
| TIMING | (mm) | 0 mm | 5 mm | 10 mm | 20 mm | 40 mm |
| DURING ACTUATION | 1 | 20° C. | 6° C. | 5° C. | 4° C. | 3° C. |
| | 4 | 50° C. | 16° C. | 12° C. | 9° C. | 8° C. |
| | 6 | 70° C. | 22° C. | 17° C. | 13° C. | 11° C. |

*1"FBL" is the film breakage length.
*2The temperature change in the one rotation period of the film.
*3The longitudinal distance L from the film breakage end D.

Figure 15:
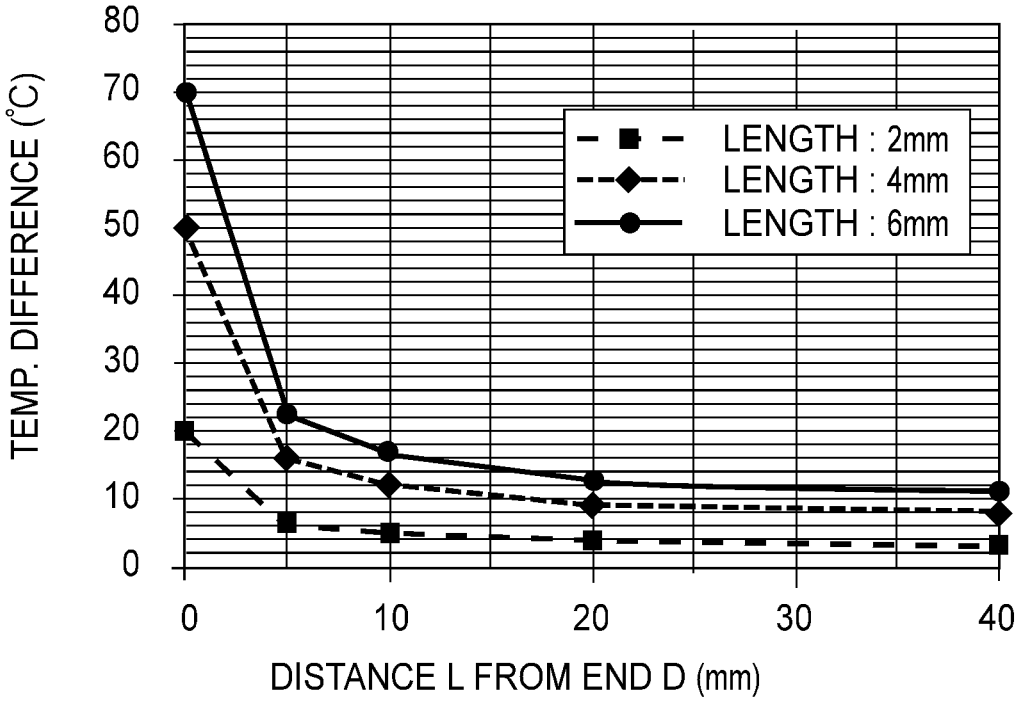
FIG. 15 is a graph showing an experimental result of Table 1.

FIG. 15 is a graph showing the result of Table 1. A result was obtained such that a degree of the temperature change in the one rotation period of the film is larger with a longer film breakage length and with a shorter longitudinal distance L from the film breakage end D. In the fixing device 110 in this embodiment, in the case where the film breakage does not occur, a constitution in which a degree of temperature non-uniformity of the film 21 with respect to the longitudinal direction can be maintained within 8° C. or less is employed in order to obviate the influence of the temperature non-uniformity of the film surface temperature on image uniformity. Accordingly, when the longitudinal distance L from the film breakage end D is 40 mm or less, the film breakage of 4 mm in length (film breakage length) can be detected.

Figure 16:
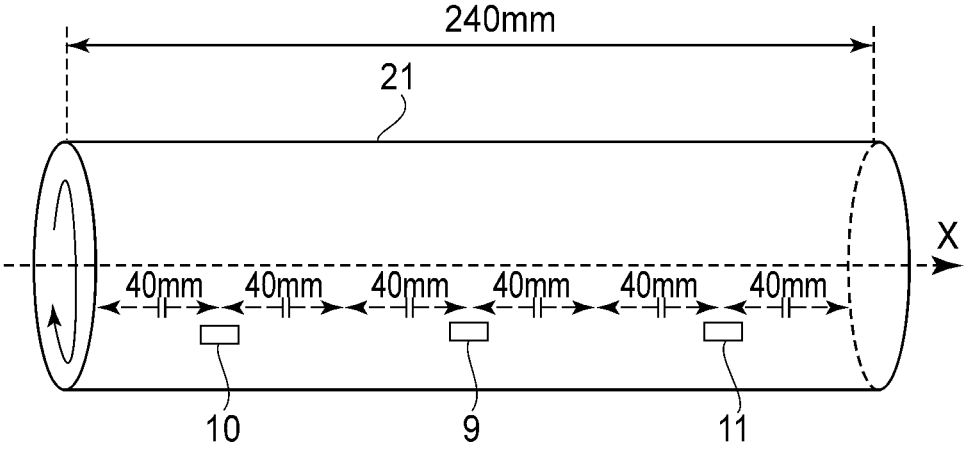
FIG. 16 is a schematic view for illustrating arrangement positions of temperature sensing elements in the fixing device in Embodiment 2.

FIG. 16 is a schematic view for illustrating longitudinal positions of the three temperature sensing elements 9, 10 and 11 in this embodiment arranged along the longitudinal direction of the film 21 in view of the above-described result.

In the fixing device 110 in this embodiment, the temperature sensing elements 10 and 11 are equidistantly disposed at positions each spaced by 80 mm from the temperature sensing element 9 disposed at the longitudinal central position of the film 21. As a result, even when the temperature sensing elements are not disposed at positions directly opposing the film breakage end D, by any one of the three temperature sensing elements 9, 10 and 11, the generated film breakage can be detected from the temperature change amount in the one rotation period of the film.

In the film 21 in this embodiment, a heat-resistant temperature of each of the elastic layer 21*b* formed with the silicone rubber and the parting layer 21*c* formed with the fluorine-containing resin tube on the outer surface of the elastic layer 21*b* is 230° C. The temperature control target temperature of the fixing device is 160° C., and the film surface maximum temperature at the film breakage end D in the case of the film breakage length of 4 mm is 50° C. higher than that in the case of no film breakage, so that it is possible to quickly detect the film breakage at the heat-resistance temperature or less.

(3) Film Breakage Detecting Method Based on Temperature Change in Film One Rotation Period.

In this embodiment, a film breakage detecting method in the fixing device 110 and an operation of the image forming apparatus in the case where the film breakage is detected are, similarly as in the case of the fixing device 110 in Embodiment 1, stored as a film breakage detecting sequence in a memory and are carried out by the engine controller 302. Also, the film breakage detecting sequence in this embodiment is, similarly as in Embodiment 1, carried out during the actuation of the fixing device 110 before the film surface temperature reaches the temperature control target temperature. The film breakage detecting sequence in this embodiment is the same as that in Embodiment 1 except that in Step 1-3 in FIG. 1, as the temperature change amount in the one rotation period of the film, the difference between the maximum temperature and the reference temperature (average temperature) in the one rotation period of the film is used.

As described above, the fixing device 110 in this embodiment includes the film 21 generating heat by the current (circumferential direction current) flowing in the direction parallel to the rotational direction of the film 21. Also, the fixing device 110 includes the plurality of the temperature sensing elements 9, 10 and 11 disposed along the longitudinal direction of the film 21, and monitors the temperature change amount in the one rotation period of the film on the basis of each of detection temperatures by these temperature sensing elements. Then, in the case where the temperature change amount in the one rotation period of the film is larger than the value, the controller discriminates that the film breakage occurs. In the case where the controller discriminates that the film breakage occurs, before the film breakage causes an image defect such as an image non-uniformity or hot offset, the electric power supply to the film 21 is stopped or the user is notified of the abnormality of the device, and therefore it is possible to improve the performance of the image forming apparatus 100.

[Heat-Generating Mechanism of Fixing Devices 110 of Embodiments]

(1) Heat-Generating Mechanism of Fixing Devices 110

With reference to (*a*) of FIG. 18, the heat-generating mechanism of the fixing devices 110 in Embodiments 1 and 2 will be described specifically.

The magnetic lines of force (indicated by dots) generated by passing the AC current through the exciting coil 3 pass through the inside of the magnetic core 22 inside the heat generating layer (hereinafter, referred to as an electroconductive layer 21*a* in the generatrix direction (a direction from S toward N). Then, the magnetic lines of force move to the outside of the electroconductive layer 21*b* from one end (N) of the magnetic core 22 and return to the other end (S) of the magnetic core 22. As a result, the induced electromotive force for generating magnetic lines of force directed in a direction of preventing an increase and a decrease of magnetic flux penetrating the inside of the electroconductive layer 21*b* in the generatrix direction of the electroconductive layer 21*a* is generated in the electroconductive layer 21*a*, so that the current is indicated along a circumferential direction of the electroconductive layer 21*a*. By the Joule heat due to this induced current, the electroconductive layer 21*a* generates heat. The magnitude of the induced electromotive force V generated in the electroconductive layer 21*a* is proportional to the change amount per unit time ($\Delta\phi/\Delta t$) of the magnetic flux passing through the inside of the electroconductive layer 21*a* and the winding number of the coil as shown in the following formula (500).

$$V = -N\frac{\Delta\Phi}{\Delta t} \tag{500}$$

Figure 18:
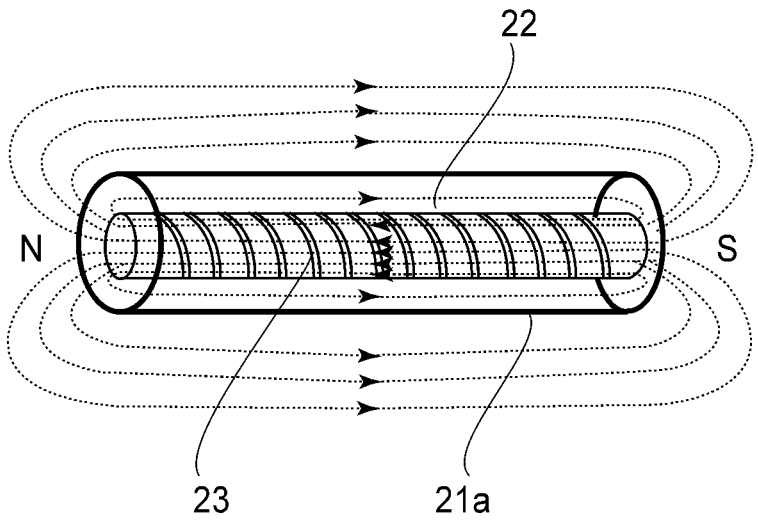
In FIG. 18, (*a*) is a schematic view of a heat generating layer, a magnetic core, an exciting coil and magnetic lines of force in the fixing device in Embodiment 2, and (*b*) is a schematic view of the magnetic core in the case where a closed magnetic circuit is formed in Embodiment 2.
Figure 18:
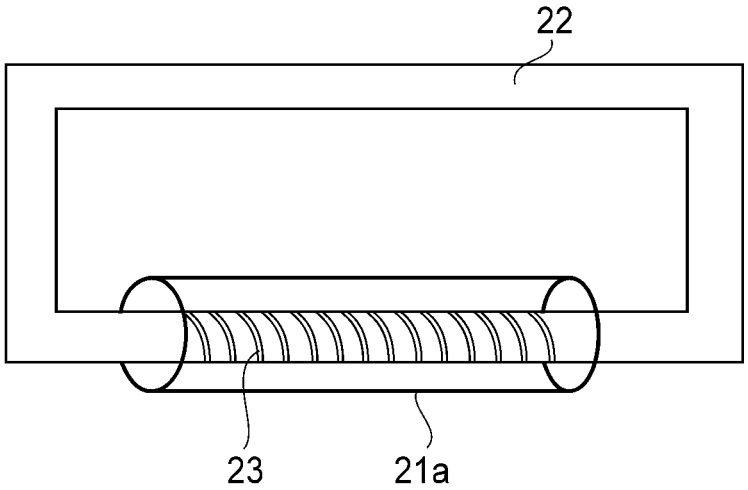

(2) Relationship between proportion of magnetic flux passing through outside of electroconductive layer and conversion efficiency of electric power The magnetic core 22 in (*a*) of FIG. 18 does not form a loop and has a shape having end portions. As shown in (*b*) of FIG. 18, the magnetic lines of force in the fixing device in which the magnetic core 22 forms a loop outside the electroconductive layer 21*a* come out from the inside to the outside of the electroconductive layer 21*a* by being induced in the magnetic core 22 and then return to the inside of the electroconductive layer 21*a*.

However, as in this embodiment, in the case of the constitution in which the magnetic core 22 has the end portions, the magnetic lines of force coming out of the end portions of the magnetic core 22 are not induced. For this reason, with respect to a path (from N to S) in which the magnetic lines of force coming out of one end of the magnetic core 22 return to the other end of the magnetic core 22, there is a possibility that the magnetic lines of force pass through both of an outside route in which the magnetic lines of force pass through the outside of the electroconductive layer 21*a* and an inside route in which the magnetic lines of force pass through the inside of the electroconductive layer 21*a*. Hereinafter, a route in which the magnetic lines of force pass through the outside of the electroconductive layer 21*a* from N toward S of the magnetic core 22 is referred to as the outside route, and a route in which the magnetic lines of force pass through the inside of the electroconductive layer 21*a* from N toward S of the magnetic core 22 is referred to as the inside route.

Of the magnetic lines of force coming out of one end of the magnetic core 22, the proportion of the magnetic lines of force passing through the outside route correlates with electric power (conversion efficiency of electric power), consumed by the heat generation of the electroconductive layer 21*a*, of electric power supplied to the exciting coil 23, and is an important parameter. With an increasing proportion of the magnetic lines of force passing through the outside route, the electric power (conversion efficiency of electric power), consumed by the heat generation of the electroconductive layer 21*a*, of the electric power supplied to the exciting coil 23 becomes higher.

The reason therefore is that a principle thereof is the same as a phenomenon that the conversion efficiency of the electric power becomes high when leakage flux is sufficiently small in a transformer and the number of magnetic fluxes passing through the inside of primary winding of the transformer and the number of magnetic fluxes passing through the inside of secondary winding of the transformer are equal to each other. That is, in this embodiment, the conversion efficiency of the electric power becomes higher with a closer degree of the numbers of the magnetic fluxes passing through the inside of the magnetic core 22 and the magnetic fluxes passing through the outside route, so that the high-frequency current passed through the exciting coil 23 can be efficiently subjected to, as the circumferential direction current, electromagnetic induction.

In (*a*) of FIG. 18, the magnetic lines of force passing through the inside of the magnetic core 22 from S toward N and the magnetic lines of force passing through the inside route are opposite in direction to each other, and therefore these magnetic lines of force cancel each other as the whole induction the electroconductive layers 21*a* including the magnetic core 22. As a result, the number of magnetic lines of force (magnetic fluxes) passing through a whole of the inside of the electroconductive layer 21*a* form S toward N decreases, so that the change amount per unit time of the magnetic flux becomes small. When the change amount per unit time of the magnetic flux decreases, the induced electromotive force generated in the electroconductive layer 21*a* becomes small, so that the heat generation amount of the electroconductive layer 21*a* becomes small.

As described above, in order to obtain the necessary electric power conversion efficiency by the fixing device 110 in the Embodiment 2, control of the proportion of the magnetic lines of force passing through the outside route is important.

The proportion passing through the outside route in the fixing device 110 is represented using an index called permeance, representing the ease of passing of the magnetic lines of force. First, a general way of thinking about a magnetic circuit will be described. A circuit of a magnetic path along which the magnetic lines of force pass is called the magnetic circuit relative to an electric circuit. When the magnetic flux is calculated in the magnetic circuit, the calculation can be made in accordance with calculation of the current in the electric circuit. To the magnetic circuit, the Ohm's law regarding the electric direction is applicable. When the magnetic flux corresponding to the current in the electric circuit is Φ, a magnetomotive force corresponding to the electromotive force is V, and a magnetic reluctance corresponding to an electrical resistance is R, these parameter satisfy the following formula (501).

$$\Phi = V/R \tag{501}$$

However, for describing the principle in an easy-to-understood manner, a description will be provided using permeance P. When the permeance P is used, the above formula (501) can be represented by the following formula (502).

$$\Phi = V \times P \tag{502}$$

Further, when a length of the magnetic path is B, a cross-sectional area of the magnetic path is S and permeability of the magnetic path is μ, the permeance P can be represented by the following formula (503).

$$P = \mu \times S/B \tag{503}$$

The permeance P is proportional to the cross-sectional area S and the permeability μ, and is inversely proportional to the magnetic path length B.

Figure 19:
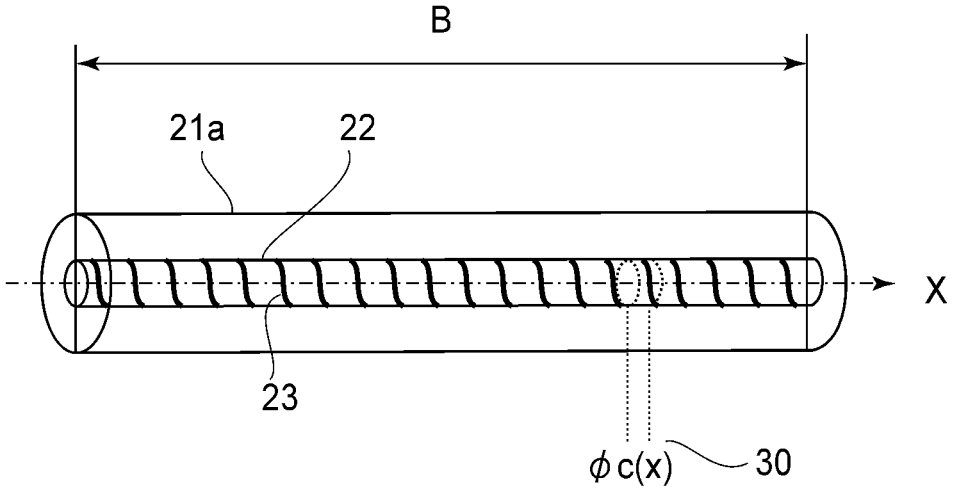
In FIG. 19, (*a*) and (*b*) are schematic views of a structure in which a finite-length solenoid is provided.
Figure 19:
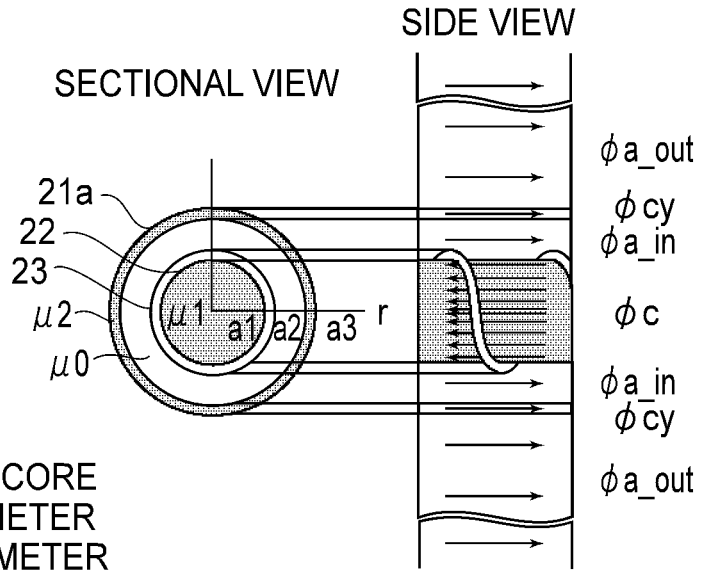

In FIG. 19, (*a*) is a schematic view showing the coil 23 wound N (times) around the magnetic core 22, of a1 (m) in radius, B (m) in length and μ1 in relative permeability, inside the electroconductive layer 21*a* in such a manner that a helical axis of the coil 23 is substantially parallel to the generatrix direction of the electroconductive layer 21*a*. In this case, the electroconductive layer 21*a* is an electroconductor of B (m) in length, a2 (m) in inner diameter, a3 (m) in outer diameter and μ2 in relative permeability. Space permeability induction and outside the electroconductive layer 1*b* is μ0 (H/m). When a current I (A) is passed through the coil 23, magnetic flux 8 generated per unit length of the magnetic core 2 is ϕc (x).

In FIG. 19, (*b*) is a sectional view perpendicular to the longitudinal direction of the magnetic core 22. Arrows in the figure represent magnetic fluxes, parallel to the longitudinal direction of the magnetic core 22, passing through the inside of the magnetic core 22, the induction of the electroconductive layer 21*a* and the outside of the electroconductive layer 21*a* when the current I is passed through the coil 23. The magnetic flux passing through the inside of the magnetic core 22 is c (=ϕc(x)), the magnetic flux passing through the inside of the electroconductive layer 21*a* (in a region between the electroconductive layer 21*a* and the magnetic core 22) is ϕa_in, the magnetic flux passing through the electroconductive layer itself is ϕs, and the magnetic flux passing through the outside of the electroconductive layer is ϕa_out.

Figure 20:
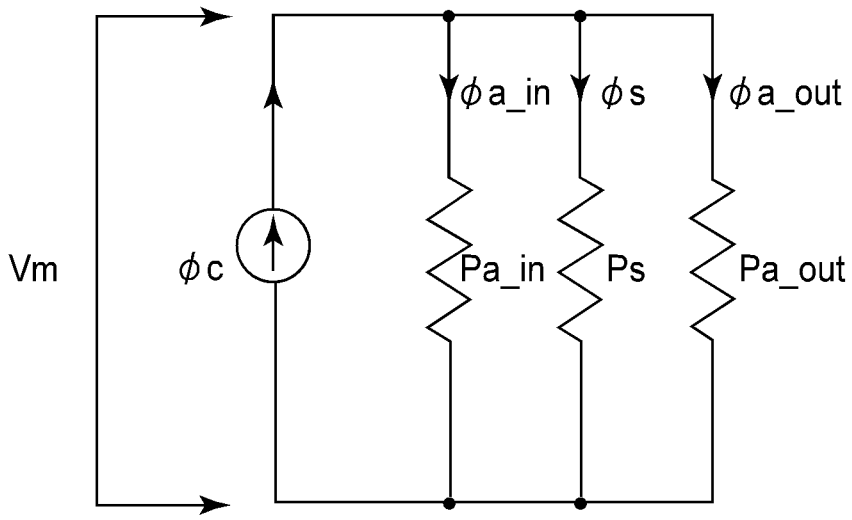
In FIG. 20, (*a*) and (*b*) are magnetic equivalent circuit diagrams in a space including the magnetic core, the exciting coil and the film per unit length.
Figure 20:
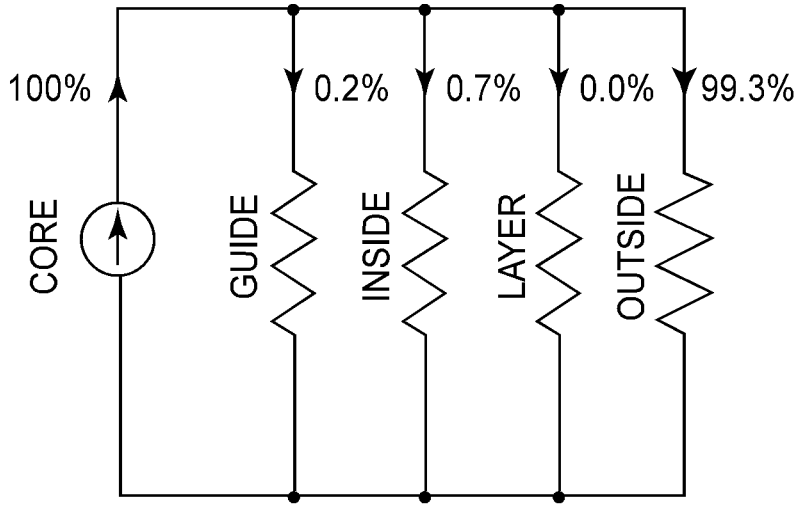

In FIG. 20, (*a*) shows a magnetic equivalent circuit in a space including the core 22, the coil 23 and the electroconductive layer 21*a* per unit length, which are shown in (*a*) of FIG. 18. The magnetomotive force generated by the magnetic flux ϕc passing through the magnetic core 22 is Vm, the permeance of the magnetic core 22 is Pc, and the permeance inside the electroconductive layer 1*b* is Pa_in. Further, the permeance in the electroconductive layer 21*a* itself of the film 21 is Ps, and the permeance outside the electroconductive layer 21*a* is Pa_out.

When Pc is large enough compared with Pa_in and Ps, it would be considered that the magnetic flux coming out of one end of the magnetic core 22 after passing through the inside of the magnetic core 22 returns to the other end of the magnetic core 22 after passing through either of ϕa_in, ϕs and ϕa_out. Therefore, the following formula (504) holds.

$$\phi c=\phi a_\text{in}+\phi s+\phi a_\text{out} \tag{504}$$

Further, ϕc, ϕa_in, ϕs and ϕa_out are represented by the following formulas (505) to (508), respectively.

$$\phi c=Pc\times Vm \tag{505}$$

$$\phi s=Ps\times Vm \tag{506}$$

$$\phi a_\text{in}=Pa_\text{in}\times Vm \tag{507}$$

$$\phi a_\text{out}=Pa_\text{out}\times Vm \tag{508}$$

Therefore, when the formulas (505) to (508) are substituted into the formula (504), Pa_out is represented by the following formula (509).

$$\begin{aligned} Pc\times Vm &= \text{Pa_in}\times Vm + \\ &\quad Ps\times Vm + \text{Pa_out}\times Vm \\ &= (\text{Pa_in} + Ps + \text{Pa_out})\times Vm \therefore \text{Pa_out} \\ &= Pc - \text{Pa_in} - Ps \end{aligned} \tag{509}$$

$$\begin{aligned} Pc &= \mu 1\times Sc \\ &= \mu 1\times \Pi(a1)^2 \end{aligned} \tag{510}$$

$$\begin{aligned} \text{Pa_in} &= \mu 0\times \text{Sa_in} \\ &= \mu 0\times \Pi\times((a2)^2-(a1)^2) \end{aligned} \tag{511}$$

$$\begin{aligned} Ps &= \mu 2\times Ss \\ &= \mu 2\times \Pi\times((a3)^2-(a2)^2) \end{aligned} \tag{512}$$

When the formulas (510) to (512) are substituted into the formula (509), Pa_out is represented by the following formula (513).

$$\begin{aligned} \text{Pa_out} &= Pc - \text{Pa_in} - Ps \\ &= \mu 1\times Sc - \mu 0\times \text{Sa_in} - \mu 2\times Ss \\ &= \Pi\times\mu 1\times(a1)^2 - \\ &\quad \Pi\times\mu 0\times((a2)^2-(a1)^2) - \\ &\quad \Pi\times\mu 2\times((a3)^2-(a2)^2) \end{aligned} \tag{513}$$

By using the above formula (513), Pa_out/Pc, which is a proportion of the magnetic lines of force passing through the outside of the electroconductive layer 21*a*, can be calculated.

In place of the permeance P, the magnetic reluctance R may also be used. In the case where the magnetic reluctance R is used, the magnetic reluctance R is simply the reciprocal of the permeance P, and therefore the magnetic reluctance R per unit length can be expressed by "1/((permeability)×(cross-sectional area)), and the unit is "1/(H·m)".

A result of specific calculation using parameters of the fixing device 110 in Embodiment 2 is shown in Table 2.

TABLE 2

| Item | U*1 | MC*2 | FG*3 | IEL*4 | EL*5 | OEL*6 |
|---|---|---|---|---|---|---|
| CSA*7 | $m^2$ | 1.5E−04 | 1.0E−04 | 2.0E−04 | 1.5E−06 | |
| RP*8 | | 1800 | 1 | 1 | 1 | |
| P*9 | H/m | 2.3E−03 | 1.3E−06 | 1.3E−06 | 1.3E−06 | |
| PUL*10 | H · m | 3.5E−07 | 1.3E−10 | 2.5E−10 | 1.9E−12 | 3.5E−07 |
| MRUL*11 | 1/(H · m) | 2.9E+06 | 8.0E+09 | 4.0E+09 | 5.3E+11 | 2.9E+06 |
| MFR*12 | % | 100.0 | 0.0 | 0.1 | 0.0 | 99.9 |

*1"U" is the unit.
*2"MC" is the magnetic core.
*3"FG" is the film guide.
*4"IEL" is the inside of the electroconductive layer.
*5"EL" is the electroconductive layer.
*6"OEL" is the outside of the electroconductive layer.
*7"CSA" is the cross-sectional area.
*8"RP" is the relative permeability.
*9"P" is the permeability.
*10"PUL" is the permeance per unit length.
*11"MRUL" is the magnetic reluctance per unit length.
*12"MFR" is the magnetic flux ratio.

When the cross-sectional area of the magnetic core 22 is Sc, the cross-sectional area inside the electroconductive layer 21*a* is Sa_in and the cross-sectional area of the electroconductive layer 21*a* itself is Ss, referring to (*b*) of FIG. 19, each of Pc, Pa_in and Ps can be represented by the product of "(permeability)×(cross-sectional area)" as shown below. The unit is "H·m".

The magnetic core 22 is formed of ferrite (relative permeability: 1800) and is 14 (mm) in diameter and $1.5\times10^{-4}$ ($m^2$) in cross-sectional area. The nip forming member 24 is formed of PPS (polyphenylene sulfide) (relative permeability: 1.0) and is $1.0\times10^{-4}$ ($m^2$) in cross-sectional area. The electroconductive layer 21*a* is formed of aluminum (relative permeability: 1.0) and is 24 (mm) in diameter, 20 (μm) in thickness and $1.5\times10^{-6}$ ($m^2$) in cross-sectional area.

The cross-sectional area of the region between the electroconductive layer 21*a* and the magnetic core 22 is calculated by subtracting the cross-sectional area of the magnetic core 2 and the cross-sectional area of the nip forming member 24 from the cross-sectional area of the hollow portion inside the electroconductive layer 21*a* of 24 mm in diameter. The elastic layer 21*b* and the parting layer 21*c* are provided outside the electroconductive layer 21*a* and do not contribute to the heat generation. Accordingly, in a magnetic circuit model for calculating the permeance, the layers 21*b* and 21*c* can be regarded as air layers outside the electroconductive layer 21*a* and therefore there is no need to add the layers into the calculation.

From Table 2, Pc, Pa_in and Ps are values shown below.

$$Pc=3.5\times10^{-7}(H\cdot m)$$

$$Pa_\mathrm{in}=1.3\times10^{-10}+2.5\times10^{-10}(H\cdot m)$$

$$Ps=1.9\times10^{-12}(H\cdot m)$$

From a formula (514) shown below, Pa_out/Pc can be calculated using these values.

$$Pa_\mathrm{out}/Pc=(Pc-Pa_\mathrm{in}-Ps)/Ps=0.999(99.9\%) \tag{514}$$

The magnetic core 22 is divided into a plurality of cores with respect to the longitudinal direction, and a spacing (gap) is provided between adjacent divided cores in some cases. In the case where this spacing is filled with the air or a material of which relative permeability can be regarded as 1.0 or of which relative permeability is considerably smaller than the relative permeability of the magnetic core 22, the magnetic reluctance R of the magnetic core 22 as a whole becomes large, so that the function of inducing the magnetic lines of force degrades.

A calculating method of the permeance of the magnetic core 22 divided in the plurality of cores described above becomes complicated. In the following, a calculating method of the permeance of a whole of the magnetic core 22, in the case where the magnetic core 22 is divided into the plurality of cores which are equidistantly arranged via the spacing or the sheet like non-magnetic material, will be described. In this case, the magnetic reluctance over a longitudinal full length is derived and then is divided by the longitudinal full length to obtain the magnetic reluctance per unit length, and thereafter there is a need to obtain the permeance per unit length using the reciprocal of the magnetic reluctance per unit length.

Figure 21:
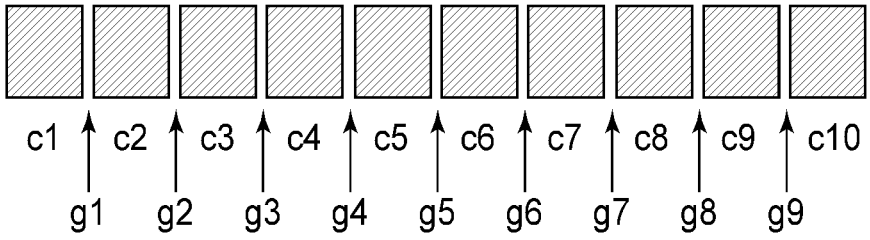
FIG. 21 is a schematic view showing magnetic cores and gaps therebetween.

First, a schematic view of the magnetic core 22 with respect to the longitudinal direction is shown in FIG. 21. Each of magnetic cores c1 to c10 is Sc in cross-sectional area, μc in permeability and Lc in width, and each of gaps g1 to g9 is Sg in cross-sectional area, μg in permeability and Lg in width. A total magnetic reluctance Rm_all of these magnetic cores with respect to the longitudinal direction is given by the following formula (515).

$$Rm_\mathrm{all}=(Rm_c1+Rm_c2+\ldots+Rm_c10)+(Rm_g1+Rm_g2+\ldots+Rm_g9) \tag{515}$$

In this case, the shape, the material and the gap width of the respective magnetic cores are uniform, and therefore when the sum of values of Rm_c is ΣRm_c, and the sum of values of Rm_g is ΣRm_g, the respective magnetic reluctances can be represented by the following formulas (516) to (518).

$$Rm_\mathrm{all}=(\Sigma Rm_c)+(\Sigma Rm_g) \tag{516}$$

$$Rm_c=Lc/(\mu c\times Sc) \tag{517}$$

$$Rm_g=Lg/(\mu g\times Sg) \tag{518}$$

By substituting the formulas (517) and (518) into the formula (516), the magnetic reluctance Rm_all over the longitudinal full length can be represented by the following formula (519).

$$\begin{aligned}\mathrm{Rm_all}&=\left(\sum \mathrm{Rm_c}\right)+\left(\sum \mathrm{Rm_g}\right)\\&=(Lc/(\mu c\times Sc))\times 10+\\&\quad(Lg/(\mu g\times Sg))\times 9\end{aligned} \tag{519}$$

When the sum of values of Lc is ΣLc and the sum of values of Lg is ΣLg, the magnetic reluctance Rm per unit length is represented by the following formula (520).

$$\begin{aligned}Rm&=\mathrm{Rm_all}/\left(\sum Lc+\sum Lg\right)\\&=\mathrm{Rm_all}/(L\times 10+Lg\times 9)\end{aligned} \tag{520}$$

From the above, the permeance Pm per unit length is obtained from the following formula (521).

$$\begin{aligned}Pm&=1/Rm\\&=\left(\sum Lc+\sum Lg\right)/\mathrm{Rm_all}\\&=\left(\sum Lc+\sum Lg\right)/\left[\left\{\sum Lc/(\mu c+Sc)\right\}\right]+\\&\quad\left\{\sum Lg/(\mu g+Sg)\right\}\end{aligned} \tag{521}$$

An increase in gap Lg leads to an increase in magnetic reluctance (i.e., a lowering in permeance) of the magnetic core 22. When the fixing device 110 in Embodiment 2 is constituted, on a heat generation principle, it is desirable that the magnetic core 22 is designed so as to have a small magnetic reluctance (i.e., a large permeance), and therefore it is not so desirable that the gap is provided. However, in order to prevent breakage of the magnetic core 22, the gap is provided by dividing the magnetic core 22 into a plurality of cores in some cases.

As described above, the proportion of the magnetic lines of force passing through the outside route can be represented using the permeance or the magnetic reluctance.

(4) Conversion Efficiency of Electric Power Necessary for Fixing Device

Next, the conversion efficiency of the electric power necessary for the fixing device 110 in Embodiment 2 will be described. For example, in the case where the conversion efficiency of the electric power is 80%, the remaining 20% of the electric power is converted into thermal energy by the coil, the core and the like, other than the electroconductive layer, and then is consumed. In the case where the electric power conversion efficiency is low, members, which should not generate heat, such as the magnetic core and the coil, generate heat, so that there is a need to take measures to cool the members in some cases.

Incidentally, in Embodiment 2, when the electroconductive layer 1*b* is caused to generate heat, the AC magnetic field is formed by passing the high-frequency current through the exciting coil 3. The AC magnetic field induces the current in the electroconductive layer 21*a*. As a physical model, this closely resembles magnetic coupling of the transformer. For that reason, when the electric power conversion efficiency is considered, it is possible to use an equivalent circuit of the magnetic coupling of the transformer. By the magnetic field, the exciting coil 23 and the electroconductive layer 21*a* cause the magnetic coupling, so that the electric power supplied to the exciting coil 23 is transmitted to the electroconductive layer 21*a*.

Herein, the "electric power conversion efficiency" means a ratio between the electric power supplied to the exciting coil 23 which is the magnetic field generating means and the electric power consumed by the electroconductive layer 21*a*.

In the case of this embodiment, the electric power conversion efficiency is the ratio between the electric power supplied to the high-frequency converter 306 for the exciting coil 23 shown in FIG. 1 and the electric power consumed by the electroconductive layer 21*a*. The electric power conversion efficiency can be represented by the following formula (522).

(Electric power conversion efficiency)=(electric power consumed by electroconductive layer)/(electric power supplied to exciting coil) (522)

The electric power which is supplied to the exciting coil 23 and which is then consumed by members other than the electroconductive layer 21*a* includes loss by the resistance of the exciting coil 23 and loss by a magnetic characteristic of the magnetic core material.

Figure 22:
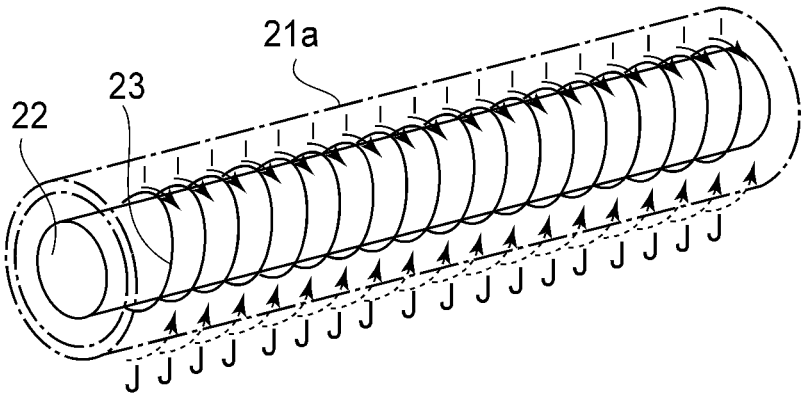
In FIG. 22, (*a*) is a perspective view of the heat generating layer, the magnetic core and the exciting coil, and (*b*) is an equivalent circuit of the coil and the film.
Figure 22:
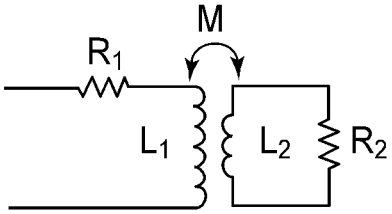

In FIG. 22, (*a*) and (*b*) are illustrations regarding the efficiency of a circuit. In (*a*) of FIG. 22, the exciting coil 23 is wound around the magnetic core 22 disposed inside the electroconductive layer 21*a*. In FIG. 22, (*b*) shows an equivalent circuit. In (*b*) of FIG. 22, R1 is loss due to the exciting coil 23 and the magnetic core 22, L1 is an inductance of the exciting coil 23 wound around the magnetic core 22, M is a mutual inductance between the winding and the electroconductive layer 21*a*, L2 is an inductance of the electroconductive layer 21*a*, and R2 is a resistance of the electroconductive layer 21*a*. An equivalent circuit when the electroconductive layer 21*a* is not mounted is shown in (*a*) of FIG. 23. By a device such as an impedance analyzer or an LCR meter, when a series equivalent resistance R1 and an equivalent inductance L1 are measured from both ends of the exciting coil 23, an impedance ZA can be represented by the following formula (523).

$$ZA=R1+j\omega L1 \tag{523}$$

The current passing through this circuit produces loss by R1. That is, R1 represents the loss due to the coil 23 and the magnetic core 22.

Figure 23:
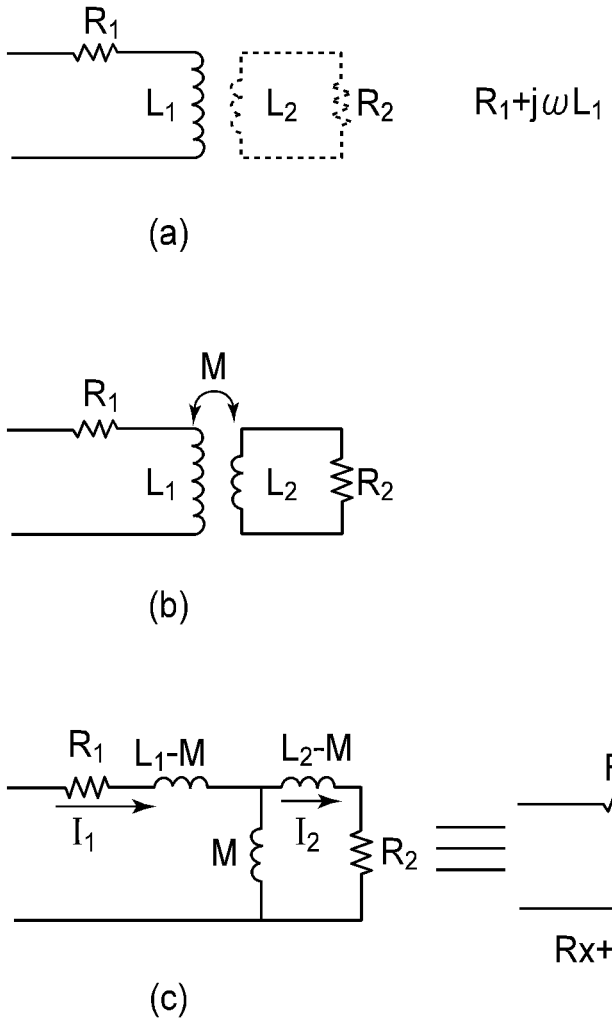
In FIG. 23, (*a*) to (*c*) are illustrations regarding efficiency of circuits.

An equivalent circuit when the electroconductive layer 21*a* is mounted is shown in (*b*) of FIG. 23. When a series equivalent resistance Rx and an equivalent inductance Lx during mounting of the electroconductive layer 21*a* are measured in advance, by making equivalent conversion as shown in (*c*) of FIG. 23, it is possible to obtain a relational expression (524).

$$\begin{aligned} Z &= R1 + j\omega(L1 - M) + \frac{j\omega M(j\omega(L2 - M) + R2)}{j\omega M + j\omega(L2 - M) + R2} \\ &= R1 + \frac{\omega^2 M^2 R_2}{R_2^2 + \omega^2 L_2^2} + j(\omega(L_1 - M) + \frac{M \cdot R_2^2 + \omega^2 M L_2(L_2 - M)}{R_2^2 + \omega^2 L_2^2} \end{aligned} \tag{524}$$

$$Rx = R_1 \frac{\omega^2 M^2 R_2}{R_2^2 + \omega^2 L_2^2} \tag{525}$$

$$Lx = \omega(L_1 - M) + \frac{M \cdot R_2^2 + \omega^2 M L_2(L_2 - M)}{R_2^2 + \omega^2 L_2^2} \tag{526}$$

In the above formulas, M represents a mutual inductance between the exciting coil and the electroconductive layer.

As shown in (*c*) of FIG. 23, when a current passing through R1 is I1 and a current passing through R2 is I2, the following formula (527) holds.

$$j\omega M(I_1 - I_2) = (R_2 + j\omega(L_2 - M))I_2 \tag{527}$$

From the formula (527), the following formula (528) can be derived.

$$I_1 = \frac{R_2 + j\omega L_2}{j\omega M} I_2 \tag{528}$$

The efficiency (electric power conversion efficiency) is represented by (electric power consumption of resistance R2)/(electric power consumption of resistance R1)+(electric power consumption of resistance R2)), and therefore can be represented by the following formula (529).

$$\begin{aligned} \text{Power conversion efficiency} &= \frac{R_2 \times |I_2^2|}{R_1 \times |I_1^2| + R_2 \times |I_2^2|} \\ &= \frac{\omega^2 M^2 R_2}{\omega^2 L_2^2 R_1 + R_1 R_2^2 + \omega^2 M^2 R_2} \\ &= \frac{Rx - R_1}{Rx} \end{aligned} \tag{529}$$

When the series equivalent resistance R1 before the mounting of the electroconductive layer 21*a* and the series equivalent resistance Rx after the mounting of the electroconductive layer 21*a* are measured, the electric power conversion efficiency showing the degree of consumption of the electric power, in the electroconductive layer 21*a*, of the electric power supplied to the exciting coil 23 can be calculated. In this embodiment (Embodiment 2), for measurement of the electric power conversion efficiency, an impedance analyzer ("4294A", manufactured by Agilient Technologies) is used.

First, in a state in which there was no fixing film 21, the series equivalent resistance R1 from the both ends of the winding was measured, and then in a state in which the magnetic core 22 was inserted into the fixing film 21, the series equivalent resistance Rx from the both ends of the winding was measured. As a result, R1=103 mΩ and Rx=2.2Ω, so that the electric power conversion efficiency at this time can be obtained as 95.3% from the formula (529). Hereinafter, the performance of the fixing device will be evaluated using this electric power conversion efficiency.

Figure 24:
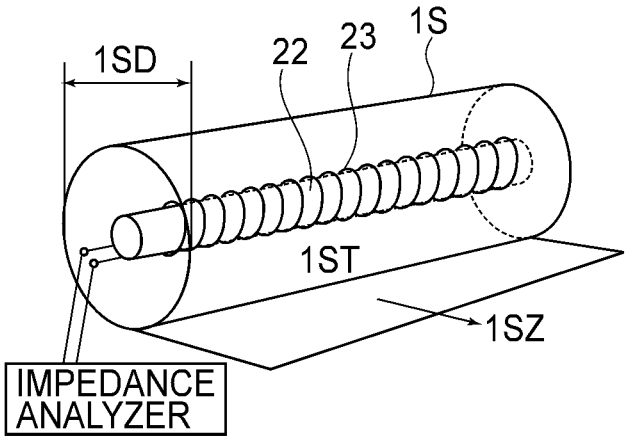
FIG. 24 is a schematic view of an experimental device used in a measuring experiment of electric power conversion efficiency.

Here, the electric power conversion efficiency necessary for the fixing device will be obtained. The electric power conversion efficiency is evaluated by changing the proportion of the magnetic flux passing through the outside route of the electroconductive layer 21*a*. FIG. 24 is a schematic view showing an experimental device used in a measurement test of the electric power conversion efficiency.

A metal sheet 1S is an aluminum-made sheet of 230 mm in width, 600 mm in length and 20 μm in thickness. This metal sheet 1S is rolled up in a cylindrical shape so as to enclose the magnetic core 22 and the coil 23, and is electrically conducted at a portion 1ST to prepare an electroconductive layer.

The magnetic core 22 is ferrite of 1800 in relative permeability and 500 mT in saturation flux density, and has a cylindrical shape of 26 $mm^2$ in cross-sectional area and 230 mm in length. The magnetic core 22 is disposed substantially at a central (axis) portion of the cylinder of the aluminum sheet 1S by an unshown fixing means. Around the magnetic core 22, the exciting coil 23 is helically wound 25 times, which is the winding number.

When an end portion of the metal sheet 1S is pulled in an arrow 1SZ direction, a diameter 1SD of the electroconductive layer can be adjusted in a range of 18 mm to 191 mm.

Figure 25:
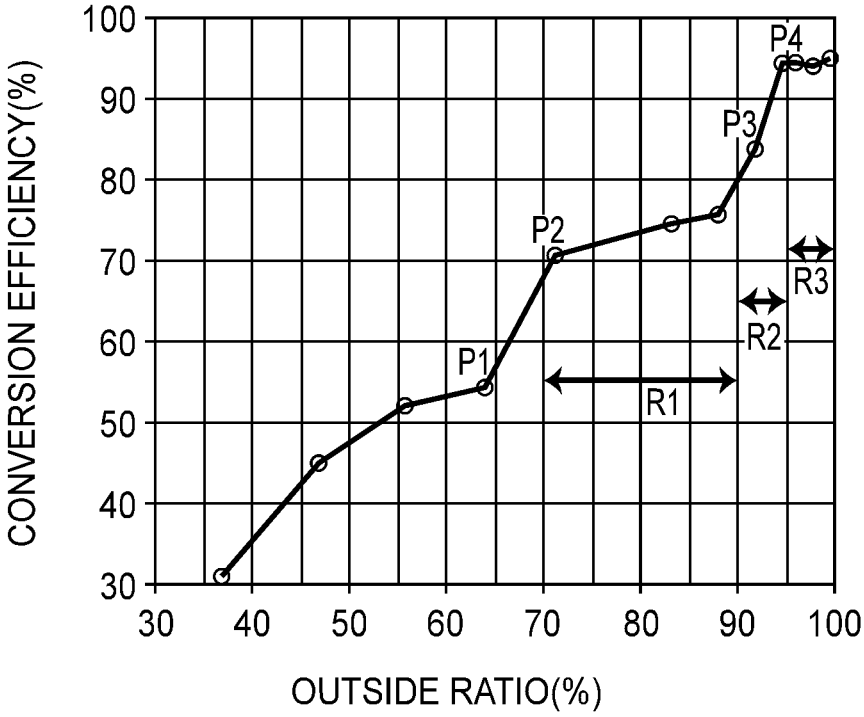
FIG. 25 is a graph showing a relationship between an outside magnetic flux ratio of the cylindrical rotatable member and the measured conversion efficiency.

FIG. 25 is a graph in which the abscissa represents the ratio (%) of the magnetic flux passing through the outside route of the electroconductive layer, and the ordinate represents the electric power conversion efficiency (%) at a frequency of 21 kHz. In the graph of FIG. 25, the electric power conversion efficiency abruptly increases from a plot P1 and then exceeds 70%, and is maintained at 70% or more in a range R1 indicated by a double pointed arrow. In the neighborhood of P3, the electric power conversion efficiency abruptly increases again and exceeds 80% in a range R2. In a range R3 from P4, the electric power conversion efficiency is stable at a high value of 94% or more. The reason why the electric power conversion efficiency abruptly increases is that the circumferential direction current starts to pass through the electroconductive layer efficiently.

Table 3 below shows a result of evaluation of constitutions, corresponding to P1 to P4 in FIG. 25, actually designed as fixing devices.

TABLE 3

| Plot | Range | D*1 (mm) | P*2 (%) | CE*3 (%) | ER*4 |
|---|---|---|---|---|---|
| P1 | — | 143.2 | 64.0 | 54.4 | IEP*5 |
| P2 | R1 | 127.3 | 71.2 | 70.8 | CM*6 |
| P3 | R2 | 63.7 | 91.7 | 83.9 | HRD*7 |
| P4 | R3 | 47.7 | 94.7 | 94.7 | OPTIMUM*8 |

*1"D" represents the electroconductive layer diameter.
*2"P" represents the proportion of the magnetic flux passing through the outside route of the electroconductive layer.
*3"CE" represents the electric power conversion efficiency.
*4"ER" represents an evaluation result in the case where the fixing device has a high specification.
*5"IEP" is that there is a possibility that the electric power becomes insufficient.
*6"CM" is that it is desirable that a cooling means is provided.
*7"HRD" is that it is desirable that heat-resistant design is optimized.
*8"OPTIMUM" is that the constitution is optimum for the flexible film.

(Fixing Device P1)

In this constitution, the cross-sectional area of the magnetic core was 26.5 $mm^2$ (5.75 mm×4.5 mm), the diameter of the electroconductive layer was 143.2 mm, and the proportion of the magnetic flux passing through the outside route was 64%. The electric power conversion efficiency, of this device, obtained by the impedance analyzer was 54.4%. The electric power conversion efficiency is a parameter indicating the degree (proportion) of electric power, contributing to heat generation of the electroconductive layer, of the electric power supplied to the fixing device. Accordingly, even when the constitution is designed as the fixing device capable of outputting 1000 W to the maximum, about 450 W is lost, resulting in less heat generation of the coil and the magnetic core.

In the case of this constitution, during rising, the coil temperature exceeds 200° C. in some cases even when 1000 W is supplied only for several seconds. When the a heat-resistant temperature of an insulating member of the coils is a high 200° C. and the Curie point of the ferrite magnetic core is about 200° C. to about 250° C. in general are taken into consideration, at the loss of 45%, it becomes difficult to maintain the member, such as the exciting coil, at the heat-resistant temperature or less. Further, when the temperature of the magnetic core exceeds the Curie point, the coil inductance abruptly decreases, so that the load fluctuates.

About 45% of the electric power supplied to the fixing device is not used for heat generation of the electroconductive layer, and therefore in order to supply an electric power of 900 W (estimated as 90% of 1000 W) to the electroconductive layer, there is a need to supply electric power of about 1636 W. This means that a power source is such that 16.36 A is consumed when 100 V is inputted. Therefore, there is a possibility that the consumed current exceeds the allowable current capable of being supplied from an attachment plug of a commercial AC power source. Accordingly, in the fixing device P1 of 54.4% in electric power conversion efficiency, there is a possibility that the electric power to be supplied to the fixing device is insufficient.

(Fixing Device P2)

In this constitution, the cross-sectional area of the magnetic core is the same as the cross-sectional area in P1, the diameter of the electroconductive layer is 127.3 mm, and the proportion of the magnetic flux passing through the outside route is 71.2%. The electric power conversion efficiency, of this device, obtained by the impedance analyzer was 70.8%. In some cases, temperature rise of the coil and the core becomes problematic depending on the specification of the fixing device.

When the fixing device of this constitution is constituted as a device having a high-performance specification, such that the apparatus performs a printing operation of 60 sheets/min, an the rotational speed of the electroconductive layer is 330 mm/sec), there is a need to maintain the temperature of the electroconductive layer at 180° C. When the temperature of the electroconductive layer is intended to be maintained at 180° C., the temperature of the magnetic core exceeds 240° C. in 20 sec in some cases. The Curie temperature (point) of ferrite used as the magnetic core is ordinarily about 200° C. to about 250° C., and therefore in some cases, the temperature of ferrite exceeds the Curie temperature and the permeability of the magnetic core abruptly decreases, and thus the magnetic lines of force cannot be properly induced by the magnetic core. As a result, it becomes difficult to induce the circumferential direction current to cause the electroconductive layer to generate heat in some cases.

Accordingly, when the fixing device in which the proportion of the magnetic flux passing through the outside route is in the range R1 is constituted as the above-described high-specification device, in order to lower the temperature of the ferrite core, it is desirable that a cooling means is provided. As the cooling means, it is possible to use an air cooling fan, water cooling, a cooling wheel, a radiation fin, heat pipe, Peltier element or the like. In this constitution, there is no need to provide the cooling means in the case where the high-performance is not required to such extent.

(Fixing Device P3)

This constitution is the case where the cross-sectional area of the magnetic core is the same as the cross-sectional area in P1, and the diameter of the electroconductive layer is 63.7 mm. The electric power conversion efficiency, of this device, obtained by the impedance analyzer was 83.9%. Although the heat quantity is steadily-generated in the magnetic core, the coil and the like, the level thereof is not a level such that the cooling means is required.

When the fixing device of this constitution is constituted as a device having a high-performance specification, such that the apparatus performs a printing operation of 60 sheets/min, and the rotational speed of the electroconductive layer is 330 mm/sec, there is a need to maintain the surface temperature of the electroconductive layer at 180° C., but the temperature of the magnetic core (ferrite) does not increase to 220° C. or more. Accordingly, in this constitution, in the case where the fixing device is constituted as the above-described high-performance specification device, it is desirable that ferrite having the Curie temperature of 220° C. or more is used.

As described above, in the case where the fixing device in which the proportion of the magnetic flux passing through the outside route is in the range R2 is used as the high-performance specification device, it is desirable that the heat-resistant design of ferrite or the like is optimized. On the other hand, in the case where the high-performance specification is not required as the fixing device, such a heat-resistant design is not needed.

(Fixing Device P4)

This constitution is the case where the cross-sectional area of the magnetic core is the same as the cross-sectional area in P1, and the diameter of the cylinder is 47.7 mm. The electric power conversion efficiency, of this device, obtained by the impedance analyzer was 94.7%.

When the fixing device of this constitution is constituted as a device having a high-performance specification such that a printing operation of 60 sheets/min, (rotational speed of electroconductive layer: 330 mm/sec), even in the case where the surface temperature of the electroconductive layer is maintained at 180° C., the temperatures of the exciting coil, and the magnetic core do not reach 180° C. or more. Accordingly, the cooling means for cooling the magnetic core, the coil and the like, and particular heat-resistant design are not needed.

As described above, in the range R3 in which the proportion of the magnetic flux passing through the outside route is 94.7% or more, the electric power conversion efficiency is 94.7% or more, and thus is sufficiently high. Therefore, even when the fixing device of this constitution is used as a further high-performance specification fixing device, the cooling means is not needed.

Further, in the range R3 in which the electric power conversion efficiency is stable at high values, even when the amount of the magnetic flux, per unit time, passing through the inside of the electroconductive layer somewhat fluctuates depending on a fluctuation in the positional relationship between the electroconductive layer and the magnetic core, the fluctuation amount of the electric power conversion efficiency is small, and therefore, the heat generation amount of the electroconductive layer is stabilized. As in the case of the flexible film, in the fixing device in which a distance between the electroconductive layer and the magnetic core is liable to fluctuate, use of the range R3 in which the electric power conversion efficiency is stable at the high values has a significant advantage.

As described above, it is understood that in the fixing device in this embodiment, the proportion of the magnetic flux passing through the outside route is required to be 72% or more in order to satisfy at least the necessary electric power conversion. In Table 3, in the fixing device in Embodiment 2, the proportion of the magnetic flux passing through the outside route is 71.2% in the range R1, but in view of a measurement error or the like, the magnetic flux proportion is required to be 72% or more.

(5) Relational Expression of Permeance or Magnetic Reluctance to be Satisfied by Fixing Device The requirement that the proportion of the magnetic flux passing through the outside route of the electroconductive layer is 72% or more is equivalent to the sum of the permeance of the electroconductive layer and the permeance of the induction (region between the electroconductive layer and the magnetic core) of the electroconductive layer being 28% or less of the permeance of the magnetic core.

Accordingly, one of features of the constitution in this embodiment is that when the permeance of the magnetic core is Pc, the permeance of the inside of the electroconductive layer is Pa, and the permeance of the electroconductive layer is Ps, the following formula (529a) is satisfied.

$$0.28 \times Pc \geq Ps + Pa \tag{529a}$$

When the relational expression of the permeance is replaced with a relational expression of the magnetic reluctance, the following formula (530) is satisfied.

$$\begin{aligned} 0.28 \times P_C &\geq P_s + P_a \\ 0.28 \times \frac{1}{Rc} &\geq \frac{1}{R_s} + \frac{1}{R_a} \\ 0.28 \times \frac{1}{Rc} &\geq \frac{1}{R_{sa}} \\ 0.28 \times R_{sa} &\geq Rc \end{aligned} \tag{530}$$

However, a combined magnetic reluctance Rsa of Rs and Ra is calculated by the following formula (531).

$$\begin{aligned} \frac{1}{R_{sa}} &= \frac{1}{R_s} + \frac{1}{R_a} \\ R_{sa} &= \frac{R_a \times R_s}{R_a + R_s} \end{aligned} \tag{531}$$

Rc: magnetic reluctance of the magnetic core

Rs: magnetic reluctance of the electroconductive layer

Ra: magnetic reluctance of the region between the electroconductive layer and the magnetic core Rsa: combined magnetic reluctance of Rs and Ra The above-described relational expression of the permeance or the magnetic reluctance may desirably be satisfied, in a cross-section perpendicular to the generatrix direction of the cylindrical rotatable member, over a whole of a maximum recording material reading region of the fixing device.

Similarly, in the fixing device in this Embodiment 2, the proportion of the magnetic flux passing through the outside route is 92% or more in the range R2.

In Table 3, in the fixing device in this embodiment, the proportion of the magnetic flux passing through the outside route is 91.7% in the range R2, but in view of a measurement error or the like, the magnetic flux proportion is 92%. The requirement that the proportion of the magnetic flux passing through the outside route of the electroconductive layer is 92% or more is equivalent to the sum of the permeance of the electroconductive layer and the permeance of the induction (region between the electroconductive layer and the magnetic core) of the electroconductive layer being 8% or less of the permeance of the magnetic core.

Accordingly, the relational expression of the permeance is represented by the following formula (532).

$$0.08 \times Pc \geq Ps + Pa \tag{532}$$

When the relational expression of the permeance is converted into a relational expression of the magnetic reluctance, the following formula (533) is satisfied.

$$\begin{aligned} 0.08 \times P_C &\geq P_s + P_a \\ 0.08 \times R_{sa} &\geq Rc \end{aligned} \tag{533}$$

Further, in the fixing device in this embodiment, the proportion of the magnetic flux passing through the outside route is 95% or more in the range R3. In Table 3, in the fixing device in this embodiment, the proportion of the magnetic flux passing through the outside route is 94.7% in the range R3, but in view of a measurement error or the like, the magnetic flux proportion is 95%. The requirement that the proportion of the magnetic flux passing through the outside route of the electroconductive layer is 95% or more is equivalent to the sum of the permeance of the electroconductive layer and the permeance of the induction (region between the electroconductive layer and the magnetic core) of the electroconductive layer being 5% or less of the permeance of the magnetic core.

Accordingly, the relational expression of the permeance is represented by the following formula (534).

$$0.05\times Pc \geq Ps+Pa \quad (534)$$

When the relational expression (534) of the permeance is converted into a relational expression of the magnetic reluctance, the following formula (535) is satisfied.

$$0.05\times P_C \geq P_s+P_a$$

$$0.05\times R_{sa} \geq Rc \quad (535)$$

Figure 26:
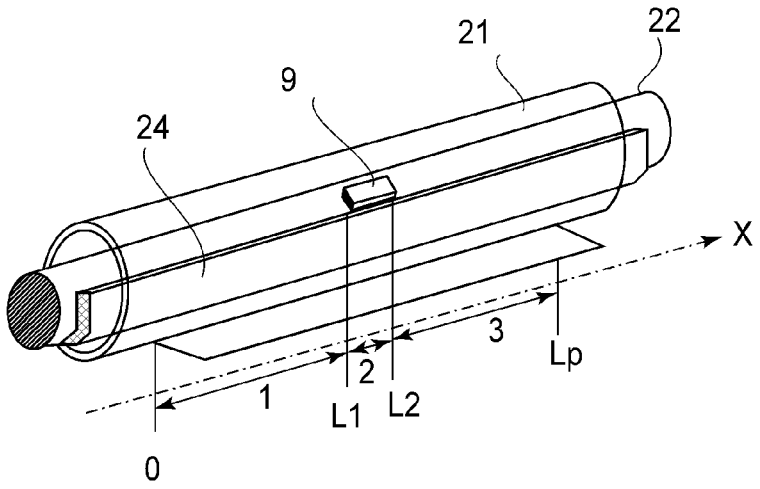
FIG. 26 is a schematic view showing a structure, of the film, the magnetic core and a nip forming member, in which a temperature detecting member is provided inside an electroconductive layer of the film.

In the above, the relational expressions of the permeance and the magnetic reluctance in the fixing device in which the member or the like in the maximum image region of the fixing device has a uniform cross-sectional structure were shown. In the following, the fixing device in which the member or the like constituting the fixing device has a non-uniform cross-sectional structure with respect to the longitudinal direction will be described. In FIG. 26, a temperature detecting member 9 is provided inside (region between the magnetic core and the electroconductive layer) of the electroconductive layer 21*a*. Other constitutions are the same as those in the above embodiment, so that the fixing device includes the film 21 including the electroconductive layer 21*a*, and includes the magnetic core 22 and the nip forming member 24.

When the longitudinal direction of the magnetic core 22 is an X-axis direction, the maximum image forming region is a range from 0 to Lp on the X-axis. For example, in the case of the image forming apparatus in which the maximum recording material feeding region is the LTR size of 215.9 mm, Lp is 215.9 mm may only be satisfied.

The temperature detecting member 9 is constituted by a non-magnetic material of 1 in relative permeability, and is 5 mm×5 mm in cross-sectional area with respect to a direction perpendicular to the X-axis and 10 mm in length with respect to a direction parallel to the X-axis. The temperature detecting member 9 is disposed at position from L1 (102.95 mm) to L2 (112.95 mm) on the X-axis.

Figure 27:
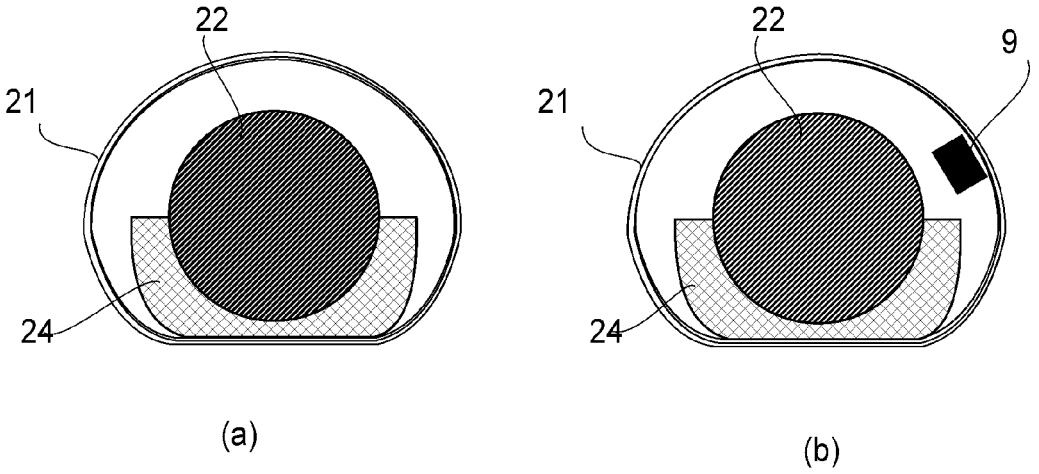
In FIG. 27, (*a*) and (*b*) are sectional views of the structure shown in FIG. 26.

Here, on the X-axis, a region from 0 to L1 is referred to as region 1, a region from L1 to L2 where the temperature detecting member 9 exists is referred to as region 2, and a region from L2 to Lp is referred to as region 3. The cross-sectional structure in the region 1 is shown in (*a*) of FIG. 27, and the cross-sectional structure in the region 2 is shown in(*b*) of FIG. 27. As shown in (*b*) of FIG. 27, the temperature detecting member 9 is incorporated in the film 21, and therefore is an object to be subjected to calculation of the magnetic reluctance. In order to strictly make the magnetic reluctance calculation, the "magnetic reluctance per unit length" in each of the regions 1, 2 and 3 is obtained separately, and an integration calculation is performed depending on the length of each region, and then the combined magnetic reluctance is obtained by adding up the integral values.

First, the magnetic reluctance per unit length of each of components (parts) in the region 1 or 3 is shown in Table 4.

TABLE 4

| Item | U*1 | MC*2 | SG*3 | IEL*4 | EL*5 |
|---|---|---|---|---|---|
| CSA*6 | $m^2$ | 1.5E−04 | 1.0E−04 | 2.0E−04 | 1.5E−06 |
| RP*7 | | 1800 | 1 | 1 | 1 |
| P*8 | H/m | 2.3E−03 | 1.3E−06 | 1.3E−06 | 1.3E−06 |
| PUL*9 | H · m | 3.5E−07 | 1.3E−10 | 2.5E−10 | 1.9E−12 |
| MRUL*10 | 1/(H · m) | 2.9E+06 | 8.0E+09 | 4.0E+09 | 5.3E+11 |

*1"U" is the unit.
*2"MC" is the magnetic core.
*3"SG" is the sleeve guide.
*4"IEL" is the inside of the electroconductive layer.
*5"EL" is the electroconductive layer.
*6"CSA" is the cross-sectional area.
*7"RP" is the relative permeability.
*8"P" is the permeability.
*9"PUL" is the permeance per unit length.
*10"MRUL" is the magnetic reluctance per unit length.

In the region 1, a magnetic reluctance per unit length (rc1) of the magnetic core is as follows.

$$rc1=2.9\times10^6(1/(H\cdot m))$$

In the region between the electroconductive layer and the magnetic core, a magnetic reluctance per unit length ($r_a$) is a combined magnetic reluctance of a magnetic reluctance per unit length ($r_f$) of the film guide and a magnetic reluctance per unit length ($r_{air}$) of the inside of the electroconductive layer. Accordingly, the magnetic reluctance $r_a$ can be calculated using the following formula (536).

$$\frac{1}{r_a}=\frac{1}{r_f}+\frac{1}{r_{air}} \quad (536)$$

As a result of the calculation, a magnetic reluctance $r_{a1}$ in the region 1 and a magnetic reluctance $r_{s1}$ in the region 1 are follows.

$$r_{a1}=2.7\times10^9(1/(H\cdot m))$$

$$r_{s1}=5.3\times10^{11}(1/(H\cdot m))$$

Further, the region 3 is equal in length to the region 1, and therefore magnetic reluctance values in the region 3 are as follows.

$$r_{c3}=2.9\times10^6(1/(H\cdot m))$$

$$r_{a3}=2.7\times10^9(1/(H\cdot m))$$

$$r_{s3}=5.3\times10^{11}(1/(H\cdot m))$$

Next, the magnetic reluctance per unit length of each of components (parts) in the region 2 is shown in Table 5.

TABLE 5

| Item | U*1 | MC*2 | SG*3 | T*4 | IEL*5 | EL*6 |
|---|---|---|---|---|---|---|
| CSA*7 | $m^2$ | 1.5E−04 | 1.0E−04 | 2.5E−05 | 1.72E−04 | 1.5E−06 |
| RP*8 | | 1800 | 1 | 1 | 1 | 1 |
| P*9 | H/m | 2.3E−03 | 1.3E−06 | 1.3E−06 | 1.3E−06 | 1.3E−06 |

TABLE 5-continued

| Item | U*1 | MC*2 | SG*3 | T*4 | IEL*5 | EL*6 |
|---|---|---|---|---|---|---|
| PUL*10 | H · m | 3.5E−07 | 1.3E−10 | 3.1E−11 | 2.2E−10 | 1.9E−12 |
| MRUL*11 | 1/(H · m) | 2.9E+06 | 8.0E+09 | 3.2E+10 | 4.6E+09 | 5.3E+11 |

*1"U" is the unit.
*2"MC" is the magnetic core.
*3"SG" is the sleeve guide.
*4"T" is the thermistor.
*6"EL" is the electroconductive layer.
*7"CSA" is the cross-sectional area.
*8"RP" is the relative permeability.
*9"P" is the permeability.
*10"PUL" is the permeance per unit length.
*11"MRUL" is the magnetic reluctance per unit length.

In the region 2, a magnetic reluctance per unit length (rc2) of the magnetic core is as follows.

$$rc2=2.9\times10^{6}(1/(H\cdot m))$$

In the region between the electroconductive layer and the magnetic core, a magnetic reluctance per unit length ($r_a$) is a combined magnetic reluctance of a magnetic reluctance per unit length ($r_f$) of the nip forming member, a magnetic reluctance per unit length ($r_t$) of the thermistor and a magnetic reluctance per unit length ($r_{air}$) of the inside air of the electroconductive layer. Accordingly, the magnetic reluctance $r_a$ can be calculated using the following formula (537).

$$\frac{1}{r_a}=\frac{1}{r_t}+\frac{1}{r_f}+\frac{1}{r_{air}} \tag{537}$$

As a result of the calculation, a magnetic reluctance per unit length ($r_{a2}$) in the region 1 and a magnetic reluctance per unit length ($r_{s2}$) in the region 2 are follows.

$$r_{a2}=2.7\times10^{9}(1/(H\cdot m))$$

$$r_{s2}=5.3\times10^{11}(1/(H\cdot m))$$

The region 3 is equal in calculating method to the region 1, and therefore the calculating method in the region 3 will be omitted.

The reason why $r_{a1}=r_{a2}=r_{a3}$ is satisfied with respect to the magnetic reluctance per unit length ($r_a$) of the region between the electroconductive layer and the magnetic core will be described. In the magnetic reluctance calculation in the region 2, the cross-sectional area of the thermistor 9 is increased, and the cross-sectional area of the inside air of the electroconductive layer is decreased. However, the relative permeability of both of the thermistor 9 and the electroconductive layer is 1, and therefore the magnetic reluctance is the same independently of the presence or absence of the thermistor 9 after all.

That is, in the case where only the non-magnetic material is disposed in the region between the electroconductive layer and the magnetic core, calculation accuracy is sufficient even when the calculation of the magnetic reluctance is similarly treated as in the case of the inside air. This is because in the case of the non-magnetic material, the relative permeability becomes a value almost close to 1. On the other hand, in the case of the magnetic material (such as nickel, iron or silicon steel), the magnetic reluctance in the region where the magnetic material exists may preferably be calculated separately from the material in another region.

Integration of magnetic reluctance R (A/Wb(1/h)) as the combined magnetic reluctance with respect to the generatrix direction of the electroconductive layer can be calculated using magnetic reluctance values r1, r2 and r3 (1/(H·m)) in the respective regions as shown in the following formula (538).

$$R=\int_0^{L1} r1\,dl1+\int_{L1}^{L2} r2\,dl1+\int_{L2}^{L\rho} r3\,dl1= r1(L1-0)+r2(L2-L1)+r3(LP-L2) \tag{538}$$

Accordingly, a magnetic reluctance Rc (H) of the core in a section from one end to the other end in the maximum recording material feeding region can be calculated as shown in the following formula (539).

$$R_c=\int_0^{L1} r_c1\,dl1+\int_{L1}^{L2} r_c2\,dl1+\int_{L2}^{L\rho} r_c3\,dl1= r_c1(L1-0)+r_c2(L2-L1)+r_c3(LP-L2) \tag{539}$$

Further, a combined magnetic reluctance Ra (H) of the region, between the electroconductive layer and the magnetic core, in the section from one end to the other end in the maximum recording material feeding region can be calculated as shown in the following formula (540).

$$R_a=\int_0^{L1} r_a1\,dl1+\int_{L1}^{l2} r_a2\,dl1+\int_{L2}^{L\rho} r_a3\,dl1= r_a1(L1-0)+r_a2(L2-L1)+r_a3(LP-L2) \tag{540}$$

Further, a combined magnetic reluctance Rs (H) of the electroconductive layer in the section from one end to the other end in the maximum recording material feeding region can be calculated as shown in the following formula (541).

$$R_s=\int_0^{L1} r_s1\,dl1+\int_{L1}^{L2} r_s2\,dl1+\int_{L2}^{Lp} r_s3\,dl1= r_s1(L1-0)+r_s2(L2-L1)+r_s3(LP-L2) \tag{541}$$

A calculation result in each of the regions 1, 2 and 3 is shown in Table 6.

TABLE 6

| Item | Region 1 | Region 2 | Region 3 | MCR*1 |
|---|---|---|---|---|
| ISP*2 | 0 | 102.95 | 112.95 | |
| IEP*3 | 102.95 | 112.95 | 215.9 | |
| D*4 | 102.95 | 10 | 102.95 | |
| pc*5 | 3.5E−07 | 3.5E−07 | 3.5E−07 | |
| rc*6 | 2.9E+06 | 2.9E+06 | 2.9E+06 | |
| Irc*7 | 3.0E+08 | 2.9E+07 | 3.0E+08 | 6.2E+08 |
| pm*8 | 3.7E−10 | 3.7E−10 | 3.7E−10 | |
| rm*9 | 2.7E+09 | 2.7E+09 | 2.7E+09 | |
| Irm*10 | 2.8E+11 | 2.7E+10 | 2.8E+11 | 5.8E+11 |
| ps*11 | 1.9E−12 | 1.9E−12 | 1.9E−12 | |
| rs*12 | 5.3E+11 | 5.3E+11 | 5.3E+11 | |
| Irs*13 | 5.4E+13 | 5.3E+12 | 5.4E+13 | 1.1E+14 |

*1"CMR" is the combined magnetic reluctance.
*2"ISP" is an integration start point (mm).
*3"IEP" is an integration end point (mm).
*4"D" is the distance (mm).
*5"pc" is the permeance per unit length (H · m).
*6"rc" is the magnetic reluctance per unit length (1/(h · m)).
*7"Irc" is integration of the magnetic reluctance rm (A/Wb(1/H)).
*8"pm" is the permeance per unit length (H · m).
*9"rm" is the magnetic reluctance per unit length (1/(h · m)).
*10"Irm" is integration of the magnetic reluctance rm (A/Wb(1/H)).
*11"ps" is the permeance per unit length (H · m).
*12"rs" is the magnetic reluctance per unit length (1/(h · m)).
*13"Irs" is integration of the magnetic reluctance rm (A/Wb(1/H)).

From Table 6, Rc, Ra and Rs are follows.

$$Rc=6.2\times10^{8}(1/H)$$

$$Ra=5.8\times10^{11}(1/H)$$

$$Rs=1.1\times10^{14}(1/H)$$

The combined magnetic reluctance Rsa of Rs and Ra can be calculated by the following formula (542).

$$\frac{1}{R_{sa}}=\frac{1}{R_s}+\frac{1}{R_a} \tag{542}$$

$$R_{sa}=\frac{R_a\times R_s}{R_a+R_s}$$

From the above calculation, $Rsa=5.8\times10^{11}(1/h)$ holds, thus satisfying the following formula (543).

$$0.28\times R_{sa}\geq Rc \tag{543}$$

As described above, in the case of the fixing device in which a non-uniform cross-sectional shape is formed with respect to the generatrix direction of the electroconductive layer, the region is divided into a plurality of regions, and the magnetic reluctance is calculated for each of the divided regions, and finally, the combined permeance or magnetic reluctance may be calculated from the respective magnetic reluctance values. However, in the case where the member to be subjected to the calculation is the non-magnetic material, the permeability is substantially equal to the permeability of the air, and therefore the calculation may be made by regarding the member as the air.

Next, the component (part) to be included in the above calculation will be described. With respect to the component which is disposed between the electroconductive layer and the magnetic core and at least a part of which is placed in the maximum recording material feeding region (0 to Lp), it is desirable that the permeance or the magnetic reluctance thereof is calculated.

On the other hand, with respect to the component (member) disposed outside the electroconductive layer, there is no need to calculate the permeance or the magnetic reluctance thereof. This is because as described above, in Faraday's law, the induced electromotive force is proportional to a change with time of the magnetic flux vertically passing through the circuit, and therefore is independent of the magnetic flux outside the electroconductive layer. Further, with respect to the member disposed out of the maximum recording material feeding region with respect to the generatrix direction of the electroconductive layer, it has no influence on the heat generation of the electroconductive layer, and therefore there is no need to make the calculation.

[Other Embodiments]

In the fixing device 110 in Embodiment 1, as the temperature change amount in the one rotation period of the film, the difference between the maximum temperature and the reference temperature (average temperature) in the one rotation period of the film described in Embodiment 2 may also be used. Alternatively, a difference between the minimum temperature and the maximum temperature in the one rotation period of the film may also be used.

In the fixing device 110 in Embodiment 2, as the temperature change amount in the one rotation period of the film, Tpp or t1 described in Embodiment 1 may also be used.

Further, in the fixing device 110 in Embodiment 2, due to a convenience of the device, it would be predicted that, e.g., the same temperature sensing element cannot be used at each of the longitudinal central and end portions. In this case, the film breakage may only be required to be detected on the basis of a table or a relational expression by, e.g., storing a corresponding relation between the temperature sensing elements in an unshown memory or the like. Or, in the case where the temperature of the temperature 21 is detected via same member, the measured temperature range by the temperature sensing element is different. Also, in such a case where the measured temperature range by the temperature sensing element is different, the film breakage may be detected on the basis of the table or the relational expression by, e.g., storing the corresponding relation between the temperature sensing elements in the unshown memory. Further, in the case where the film breakage of less than 4 mm in length is detected, the film breakage can be detected by increasing the number of the temperature sensing elements.

In the fixing devices 110 in Embodiments 1 and 2, the temperature change amount in the one rotation period of the film may also be obtained by providing two or more temperature sensing elements at longitudinal different positions of the film 1 or 21 and then by comparing results of detected temperatures by these temperature sensing elements.

In the fixing devices 110 in Embodiments 1 and 2, each of the temperature sensing elements 9, 10 and 11 is not limited to the thermistor of a non-contact, but may also be the thermistor of a contact type. These thermistors of the non-contact type or the contact type may also be disposed inside the film 1 or 21.

Further, in the case where the peripheral speed of the film 1 or 21 is high, from the viewpoint of response property of the temperature sensing elements 9, 10 and 11, it would be predicted that the temperature change amount in the one rotation period of the film cannot be detected with accuracy. In this case, the film 1 or 21 is rotated at a speed slower than the rotational speed during normal image formation, and then the above-described processes in Step 1-1 to Step 1-8 may be performed.

In general, there is a possibility that the film breakage occurs, e.g., in the case where the recording material remaining in the fixing device due to jam or the like is removed by an unintended method. Accordingly, in the case where the fixing device 110 is demounted from and mounted into the image forming apparatus 100 or during a check of the operation of the image forming apparatus immediately after the power of the image forming apparatus is turned on, the above-described processes in Step 1-1 to Step 1-8 are performed in a short time. It is desirable for the purpose of using the fixing device that the film breakage is detected as described above before the printing operation is actually performed.

In the fixing device 110 in Embodiment 1, in the case where the film surface temperature fluctuates over the entire longitudinal region of the film 1 when the film breakage occurs, also, the temperature sensing element 9 for temperature control detects the temperature change. For that reason, as shown in FIG. 5, after the temperature of the fixing device 110 reaches the temperature control target temperature, the temperature change in the one rotation period of the film becomes large in some cases. In such cases, the predetermined value, in the one rotation period of the film, used for discriminating the presence or absence of the film breakage may also be changed between during the actuation of the fixing device 110 and after the film surface temperature reaches the temperature control target temperature.

In Embodiments 1 and 2, the film breakage detecting sequence during the actuation of the fixing device 110 before the film surface temperature reaches the temperature control target temperature was described. The timing when the film breakage detecting sequence is carried out is not limited thereto, but may also be the time when the recording material P passes through the fixing device 110 or the time when the recording material P does not pass through the fixing device 110 during sheet passing. The time when the recording material P passes through the fixing device 110 refers to the time when the toner image T is heat fixed while the recording material P is fed through the nip N. The time when the recording material P does not pass through the fixing device 110 during sheet passing refers to a recording material interval between a recording material and a subsequent recording material, which are successively introduced into the nip N.

In the fixing devices 110 in Embodiments 1 and 2, as the cylindrical rotatable member, the example using the film 1 or 21 was described, but in place of the film, a so-called fixing roller in which the thickness of the heat generating layer 1*a* or 21*a* or the elastic layer 1*b* or 21*b* is thicker may also be used.

Figure 17:
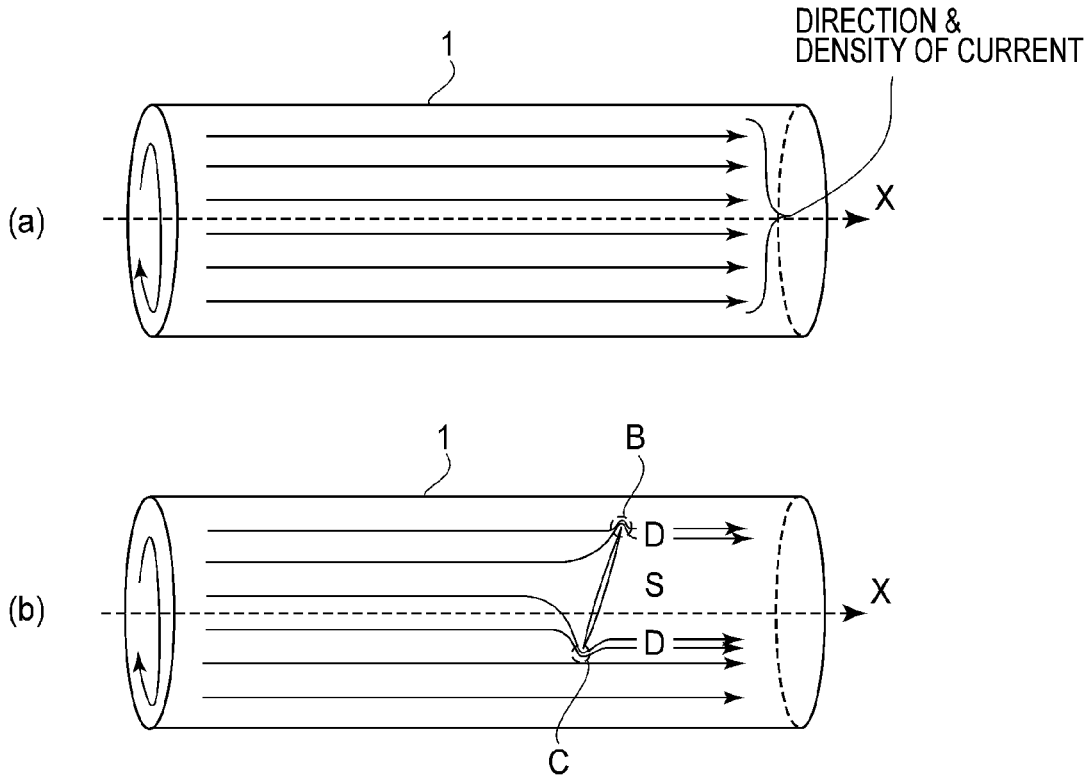
In FIG. 17, (*a*) and (*b*) are schematic views for illustrating the abnormal temperature increase phenomenon in the case where the film breakage exists in another example of the fixing device in Embodiment 1.

In the fixing device 110 in Embodiment 1, the example in which the flange members 12*a* and 12*b* are contacted to the end portions of the film 1, and the AC current is caused to flow in the direction of the film rotational axis X via these flange members to cause the film 1 to generate heat was described. As a modified example of this fixing device 110, there is also a fixing device in which a DC current is applied in the direction of the film rotational axis X via the flange members 12*a* and 12*b* contacted to the end portions of the film 1. In FIG. 17, (*a*) and (*b*) are schematic views for illustrating a phenomenon that the temperature fluctuates in the film in the rotation period in the case where the film breakage occurs in the fixing device in which the DC current is to be applied to the film 1. In FIG. 17, the flange members 12*a* and 12*b* are omitted from illustration.

In the fixing device 110 in Embodiment 1, when the times of the one rotation period of the film of the film 1 shown in (*c*) and (*d*) of FIG. 6 are averaged, the dense and sparse states of the current density are generated over the full longitudinal region of the film at the portion where the film breakage occurs, and thus the temperature change in the one rotation period of the film generated over the full longitudinal region of the film can be determined.

On the other hand, in the fixing device in which the DC current is applied to the film 1, the current flows only in one direction of the film 1 as shown in (*a*) of FIG. 17. Accordingly, as shown in (*b*) of FIG. 17, when the film breakage occurs, the dense and sparse states of the current density occur only in the region after the circumvention of the film breakage ends B and C by the current. Accordingly, similarly as in the fixing device 110 in Embodiment 1, the film temperature is not influenced by the film breakage at the position sufficiently spaced from the film breakage generation portion with respect to the longitudinal direction of the film 1.

In such a case, as described in Embodiment 2, on the basis of the detected temperature by each of the temperature sensing elements 9, 10 and 11, the temperature change amount in the one rotation period of the film is monitored. Then, in the case where the temperature change amount in the one rotation period of the film is larger than the predetermined value, the controller may only be required to discriminate that the film breakage occurs.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 261300/2013 filed Dec. 18, 2013, which is hereby incorporated by reference.

What is claimed is:

1. An image forming apparatus for forming an image on a recording material, comprising:

an image forming portion configured to form the image on the recording material;

a fixing portion, including a cylindrical rotatable member having a heat generating layer, configured to fix the image on the recording material by heat of said rotatable member; and a temperature detecting portion configured to detect the temperature of said rotatable member, said temperature detecting portion including a plurality of temperature detection sensors arranged at both longitudinal end portions of said rotatable member, wherein said temperature detecting portion monitors a temperature change amount per one rotation of said rotatable member, wherein said rotatable member is heated by the heat generating layer generating heat by a flow of a current in the heat generating layer, and wherein depending on the temperature change amount, a notification of an abnormality of said image forming apparatus is provided.

2. The apparatus according to claim 1, wherein the notification of the abnormality of said image forming apparatus is provided when the difference between a maximum temperature and a minimum temperature exceeds a predetermined value per one rotation of said rotatable member while said rotatable member is rotating.

3. An image forming apparatus for forming an image on a recording material, comprising:

an image forming portion configured to form the image on the recording material;

a fixing portion configured to fix the image on the recording material by heating of the recording material, said fixing portion including a cylindrical rotatable member having a heat generating layer, a magnetic member inserted into a hollow portion of said rotatable member and a coil wound helically outside said magnetic member at the hollow portion; and a temperature detecting portion configured to detect the temperature of said rotatable member, wherein said temperature detecting portion monitors a temperature change amount during one rotation of said rotatable member, wherein said rotatable member is heated by the heat generating layer generating heat through electromagnetic induction heating by an AC magnetic field generated by a flow of a current through said coil; and wherein depending on the temperature change amount, a notification of an abnormality of said image forming apparatus is provided.

4. The apparatus according to claim 3, wherein with respect to a generatrix direction of said rotatable member, in a section from one end to the other end of a maximum region through which the image passes, the magnetic reluctance of said magnetic member is 28% or less of a combined magnetic reluctance of the magnetic reluctance of the heat generating layer and the magnetic reluctance of a region between the heat generating layer and said magnetic member.

5. The apparatus according to claim 3, wherein 70% or more of the magnetic flux coming out of one end of said magnetic member with respect to a generatrix direction of said rotatable member returns to the other end of said magnetic member after passing through an outside of the heat generating layer.

6. The apparatus according to claim 3, wherein a helical axis of said coil extends in a generatrix direction of said rotatable member.

7. The apparatus according to claim 3, wherein the heat generating layer generates heat by an induced current, which is induced by the AC magnetic field, flowing in said heat generating layer in a circumferential direction of said rotatable member.

8. The apparatus according to claim 3, wherein said temperature detecting portion includes a plurality of temperature detecting sensors which are arranged at different positions in a generatrix direction of said rotatable member.

9. The apparatus according to claim 3, wherein said temperature detecting portion monitors the temperature change amount during a warm-up period of the fixing portion.

10. An image forming apparatus for forming an image on a recording material, comprising:

an image forming portion configured to form the image on the recording material;

a fixing portion configured to fix the image on the recording material, said fixing portion including a cylindrical rotatable member which has a heat generating layer, a magnetic member inserted into a hollow portion of said rotatable member, and a coil wound helically outside said magnetic member at the hollow portion so that the helical axis of said coil extends in a generatrix direction of said rotating member; and a temperature detecting portion configured to detect the temperature of said rotatable member, wherein an AC magnetic field is formed by a current flowing in said coil, and said heat generating layer generates heat by an induced current, which is induced by the AC magnetic field, flowing in said heat generating layer in a circumferential direction of said rotatable member, wherein the temperature detecting portion monitors a temperature change amount per one rotation of said rotatable member while said rotatable member rotating, and wherein depending on the temperature change amount, a notification of an abnormality of said image forming apparatus is provided.

11. The apparatus according to claim 10, wherein said magnetic member has a shape which does not form a loop outside said rotatable member.

12. The apparatus according to claim 11, wherein said magnetic member has the shape which has longitudinal end portions.

13. The apparatus according to claim 10, wherein said temperature detecting portion monitors the temperature change amount during a warm-up period of the fixing portion.

* * * * *